United States Patent [19]

Tanaka et al.

[11] Patent Number: 4,858,136

[45] Date of Patent: Aug. 15, 1989

[54] METHOD OF AND APPARATUS FOR CONTROLLING FUEL INJECTION QUANTITY FOR INTERNAL COMBUSTION ENGINE

[75] Inventors: Yoshiyuki Tanaka, Nagoya; Akira Ii, Toyota; Taiichi Meguro, Okazaki; Kenji Hayashi, Toyota, all of Japan

[73] Assignee: Toyota Jidosha Kabushiki Kaisha, Toyota, Japan

[21] Appl. No.: 947,385

[22] Filed: Dec. 29, 1986

[30] Foreign Application Priority Data

| | | | |
|---|---|---|---|
| Dec. 26, 1985 | [JP] | Japan | 60-295836 |
| Jan. 14, 1986 | [JP] | Japan | 61-05724 |
| Feb. 13, 1986 | [JP] | Japan | 61-29808 |
| Mar. 3, 1986 | [JP] | Japan | 61-45638 |

[51] Int. Cl.[4] ..... F02M 51/00

[52] U.S. Cl. ..... 364/431.07; 364/431.05; 123/492; 123/493

[58] Field of Search ..... 364/431.05, 431.07; 123/493, 492, 489, 480, 339

[56] References Cited

U.S. PATENT DOCUMENTS

| | | | |
|---|---|---|---|
| 4,490,792 | 12/1984 | Deutsch et al. | 364/431.07 |
| 4,508,086 | 4/1985 | Ito et al. | 123/493 |
| 4,520,784 | 6/1985 | Isobe et al. | 123/492 |
| 4,547,852 | 10/1985 | Kamifuji et al. | 364/431.07 |
| 4,643,152 | 2/1987 | Yamato | 364/431.05 |
| 4,725,954 | 2/1988 | Takao et al. | 364/431.07 |

*Primary Examiner*—Parshotam S. Lall
*Assistant Examiner*—V. N. Trans
*Attorney, Agent, or Firm*—Cushman, Darby & Cushman

[57] ABSTRACT

A method of and apparatus for controlling a fuel injection quantity for an internal combustion engine wherein the fuel injection quantity is controlled on the basis of both an intake-pipe pressure and a rotational speed of the engine. The output of a pressure sensor for detecting the intake-pipe pressure is processed by a CR filter having a time constant which enables removal of a pulsating component of the intake-pipe pressure. The output of the CR filter is relaxed to calculate a first weighted mean value with a relatively low degree of relaxation and a second weighted mean value with a relatively high degree of relaxation. The second weighted mean value is subtracted from the first weighted mean value, and an incremental/decremental quantity is determined on the basis of the result of the subtraction. The synchronous fuel injection quantity during acceleration or deceleration is corrected by the incremental/decremental quantity, and during acceleration the fuel is injected asynchronously on the basis of the incremental/decremental quantity.

20 Claims, 24 Drawing Sheets

FIG. 7
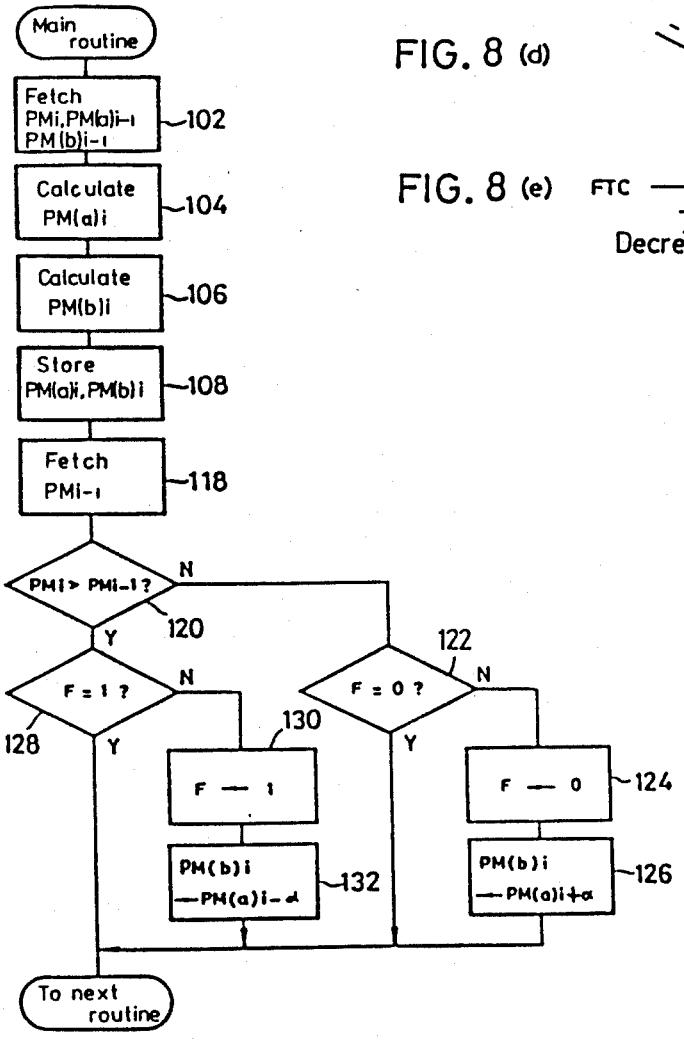
FIG. 8 (a)
FIG. 8 (b)
FIG. 8 (c)
FIG. 8 (d)
FIG. 8 (e)
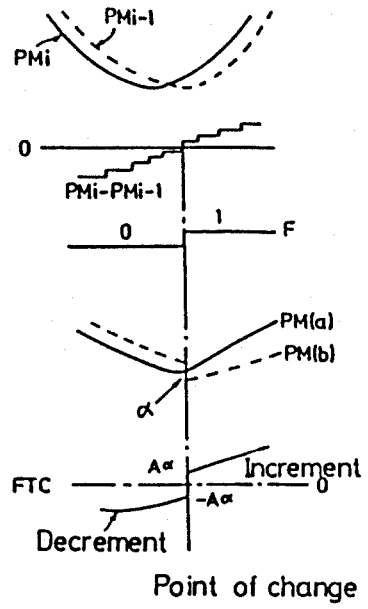

FIG. 11
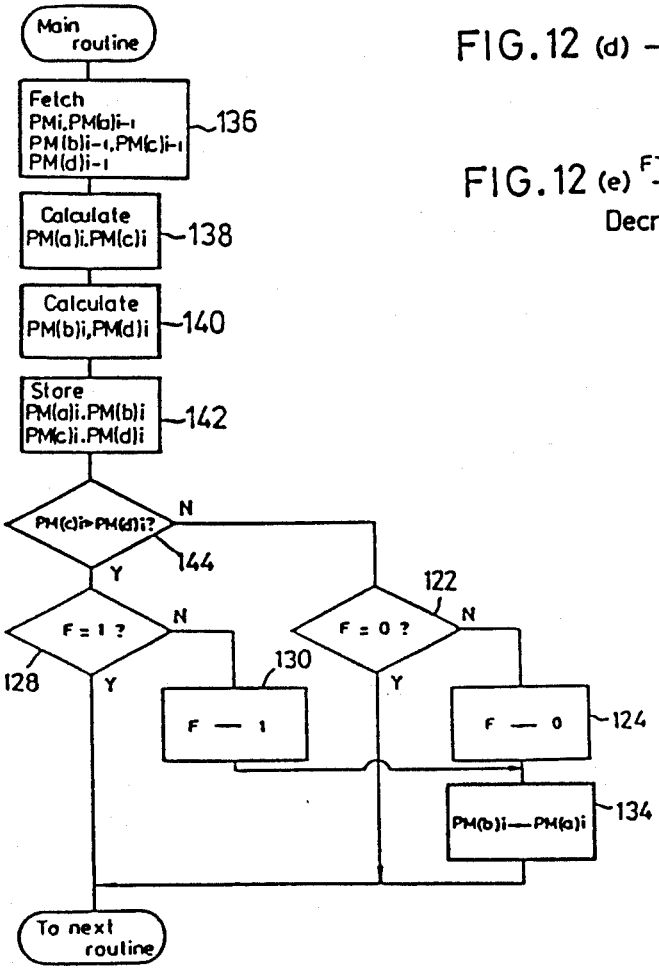
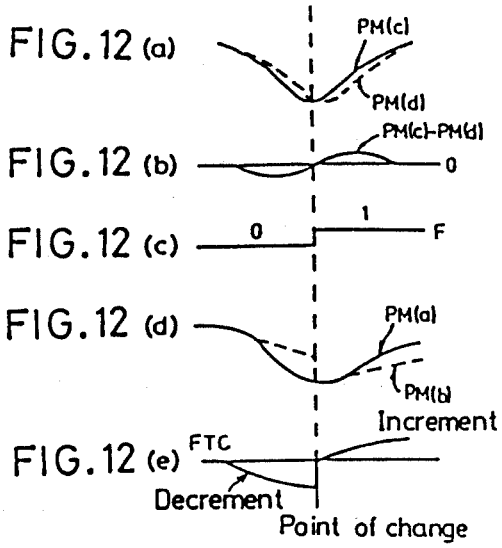

METHOD OF AND APPARATUS FOR CONTROLLING FUEL INJECTION QUANTITY FOR INTERNAL COMBUSTION ENGINE

BACKGROUND OF THE INVENTION

1. Field of the Invention

The present invention relates to a method of and apparatus for controlling a fuel injection quantity for an internal combustion engine. More particularly, the present invention pertains to a method of and apparatus for controlling a fuel injection quantity for an internal combustion engine in which the fuel injection quantity is increased synchronously or asynchronously with the crank angle during acceleration.

2. Description of the Related Art.

One type of fuel injection quantity control apparatus has heretofore been known in which a basic fuel injection quantity is determined on the basis of an intake-pipe pressure (absolute pressure) PM and a rotational speed of the engine NE, and fuel is injected every predetermined crank angle (i.e., in synchronism with the crank angle) on the basis of the basic fuel injection quantity which is corrected in accordance with, for example, the temperature of intake air and the temperature of water for cooling the engine. In this type of fuel injection quantity control apparatus, in order to improve the response of the engine at the time of acceleration, an amount ΔPM of change in the intake-pipe pressure PM is detected, and fuel to be injected is increased synchronously with the crank angle by an amount which is proportional to the detected change amount ΔPM (see Japanese Patent Laid-Open No. 35154/1985).

In the above-described fuel injection quantity control, since the intake-pipe pressure rises at a substantially constant rate during acceleration, the change amount ΔPM of the intake-pipe pressure is substantially constant, so that a substantially constant amount of fuel is incrementally injected during acceleration. However, the intake-pipe pressure increases in proportion to the degree of opening of the throttle valve. More specifically, at the beginning of acceleration, the intake-pipe pressure is relatively small, whereas, at the end of acceleration, the intake-pipe pressure is relatively large. For this reason, although at the beginning of acceleration the amount of fuel which adheres to the inner wall of the intake manifold is relatively small, a relatively large amount of fuel adheres to the manifold inner wall at the end of acceleration. Accordingly, the conventional fuel injection quantity control in which a substantially constant amount of fuel is incrementally injected during acceleration involves the problem that, at the beginning of acceleration, the air-fuel ratio of the air-fuel mixture supplied to the combustion chamber of the engine is richer than the level required by the engine, whereas, at the end of the acceleration, said air-fuel ratio becomes leaner than the required level. In consequence, although the air-fuel ratio is controlled to the required level of the engine in some regions during acceleration, it is impossible to control the air-fuel ratio to the required level throughout the acceleration, which means that the engine performance during acceleration is still unsatisfactory.

In order to improve the response of the engine at the time of acceleration, one type of internal combustion engine is adapted to execute asynchronous fuel injection in which fuel is injected asynchronously with the crank angle, in addition to the synchronous fuel injection in which the fuel is injected synchronously with the crank angle. The asynchronous fuel injection enables the amount of fuel supplied to the engine to be increased even when the intake pipe pressure rises rapidly during acceleration, so that the air-fuel ratio during acceleration can be made closer to the required level of the engine.

Examples of conventional methods for carrying out the above-described asynchronous fuel injection include a method wherein the output of a pressure sensor which is input to control means through a filter is sampled with a predetermined period, and when the difference between the presently sampled value and the previously sampled value exceeds a predetermined value, asynchronous fuel injection is executed (see Japanese Patent Laid-Open No. 90728/1984), and a method wherein the output of a pressure sensor which is input to control means through a filter is subjected to differentiation of second order with respect to time, and when the result of the differentiation exceeds a predetermined value, asynchronous fuel injection is executed (see Japanese Patent Laid-Open No. 39938/1984).

However, the filter which is used in these conventional methods has a time constant set at a relatively large value for the purpose of removing the pulsating component of the intake-pipe pressure (i.e., since the level of the pusating component reaches a maximum when the throttle valve is in a full-open position, it is necessary, in order to remove the pulsating component in all operating conditions, to set the time constant in conformity with circumstances at the time when the throttle valve is in a full-open position). For this reason, the rise of a signal which is input to the control means is delayed with respect to an actual change in the intake-pipe pressure, and this undesirably delays the timing at which asynchronous fuel injection should be started. Accordingly, asynchronous fuel injection is not executed at the very beginning of acceleration, and the performance of the engine at the beginning of acceleration is degraded. In addition, since asynchronous fuel injection is started at the time when the early stage of acceleration has passed and the intake-pipe pressure has already become relatively high, the amount of evaporated fuel decreases, and a relatively large amount of fuel adheres to the inner wall of the intake manifold, resulting, disadvantageously, in a reduction in amount of fuel supplied to the engine.

To overcome the above-described problems and improve the engine performance during acceleration by the fuel injection quantity control effected on the basis of a change amount ΔPM and by eliminating the delay in starting of asynchronous fuel injection, it may be effective practice to input the pressure sensor output to the control means through a filter having a time constant set at a relatively small value (e.g., 3 to 5 msec) so as to remove only a minimum pulsating component of the intake-pipe pressure. In such case, however, since the pulsating component cannot completely be removed by the filter, the change amount ΔPM may vary due to the remaining pulsating component, resulting, undesirably, in an excess increase in the amount of fuel injected although a steady-state running condition. If, in order to solve this problem, the threshold value employed to effect increment of fuel is raised, no increment of fuel can be effected at the time of, for example, slow acceleration. Further, when the temperature of the engine is relatively low, it is necessary to increase the amount of fuel injected in proportion to the rise in the intake-pipe pressure even in the latter part of acceleration during which the change amount ΔPM in the intake-pipe pressure becomes small. However, in such case, since the change amount ΔPM in the intake-pipe pressure is small, the required increase in the amount of fuel cannot be achieved. In order to carry out increment of fuel in proportion to the change amount ΔPM even in the latter period of acceleration, it is necessary to effect a complicated control such as one in which the time constant of the filter is made variable.

With respect to the asynchronous fuel injection also, if a filter having a relatively small time constant is employed, the pulsating component cannot completely be removed by the filter, and this involves the problem that the difference in terms of sampled values or a value obtained by differentiation of second order may exceed a predetermined value not only at the time of acceleration but also at the time of a steady-state running condition wherein the pulsating componet is relatively large, resulting in undesirable execution of asynchronous fuel injection. Such problem can be solved by increasing the above-described predetermined value. However, if said value is increased, asynchronous fuel injection cannot be executed at the required timing during acceleration. Accordingly, the engine performance during acceleration is degraded, and the condition of exhaust emission becomes worse.

SUMMARY OF THE INVENTION

In view of the above-described circumstances, it is an object of the present invention to provide a method of and apparatus for controlling a fuel injection quantity for an internal combustion engine which enables an air-fuel mixture to be controlled to an air-fuel ratio required by the engine in a transient state such as acceleration.

It is another object of the present invention to provide a fuel injection method for an internal combustion engine which enables asynchronous fuel injection to be executed at the required timing without being affected by the pulsating component of the intake-pipe pressure.

To these ends, according to a first aspect of the present invention, there is provided an apparatus for controlling a fuel injection quantity for an internal combustion engine, comprising: pressure detecting means for detecting an intake-pipe pressure; first mean value detecting means for detecting a present first weighted mean value of intake-pipe pressure by using a first weighted mean value of intake-pipe pressure detected in the past and a present intake-pipe pressure and making heavier the weight given to the first weighted mean value detected in the past; second means value detecting means for detecting a present second weighted mean value of intake-pipe pressure by using a second weighted mean value of intake-pipe pressure detected in the past and a present intake-pipe pressure and making the weight given to the second weighted mean value detected in the past heavier than the weight given by the first mean value detecting means; calculating means for determining an incremental/decremental quantity for the fuel injection quantity on the basis of the value obtained by subtracting the present second weighted mean value from the present first weighted mean value; and fuel injection means for varying the fuel injection quantity on the basis of the incremental/decremental quantity.

The action and effect of the first aspect of the present invention will be described below with reference to FIG. 1.

It is assumed that the intake-pipe pressure PM changes as shown in FIG. 1, and a present first weighted mean value and a present second weighted mean value are represented by the following general expression:

$$\overline{PM_i} = \frac{PM_i + (K-1)\,\overline{PM_{i-1}}}{K} \qquad (1)$$

where $PM_i$ is a present intake-pipe pressure detected by the pressure detecting means, $\Delta\overline{PM_{i-1}}$ is a weighted mean value of intake-pipe pressure detected in the past, $\Delta\overline{PM_i}$ is a weighted mean value of intake-pipe pressure detected at present, and K is a constant corresponding to the weight.

When the constant K in the expression (1) is decreased (e.g., 4), a first weighted mean value PM(a) can be detected, whereas, when the constant K is increased (e.g., 64), a second weighted mean value PM(b) can be detected. Since the degree at which the first weighted mean value PM(a) relaxes is set so as to be relatively small, PM(a) substantially follows up the actual intake-pipe pressure PM as shown in FIG. 1. However, since the degree at which the second weighted mean value PM(b) relaxes is set so as to be relatively large, PM(b) is inferior to PM(a) in terms of follow-up characteristics. Accordingly, the incremental/decremental quantity FTC for the fuel injection quantity which is determined on the basis of a value obtained by subtracting the second weighted mean value PM(b) from the first weighted mean value PM(a) reaches substantially maximum near the time when the change in the intake-pipe pressure PM ends, and reaches a minimum when the change in the intake-pipe pressure PM begins and after a predetermined period of time has passed from the end of the change, as shown in FIG. 1. Accordingly, the increment of the fuel injection quantity is gradually increased from the beginning to the end of acceleration, and the fuel injection quantity increment is gradually decreased after the end of acceleration, so that, when the amount of fuel adhering to the inner wall of the intake manifold is taken into consideration, the air-fuel ratio of the air-fuel mixture supplied to the combustion chamber of the engine is maintained at a substantially constant level and therefore controlled so as to be substantially equal to the level required by the engine throughout acceleration. During deceleration, the result of the subtraction of the second weighted mean value PM(b) from the first weighted mean value PM(a) is negative, and therefore decrement of the fuel injection quantity is effected.

Thus, according to the first aspect of the present invention, it is advantageously possible to control the air-fuel ratio so as to be substantially equal to the level required by the engine throughout acceleration, so that the engine acceleration performance can be improved throughout acceleration.

In the arrangement according to the first aspect of the present invention, when the running condition of the engine is suddenly shifted from deceleration to acceleration as in the case of a shift change, the first weighted mean value PM(a) and the second weighted mean value PM(b) change as shown in FIG. 2A, and the decrement of the fuel injection quantity is undesirably continued even when the intake-pipe pressure PM reaches a minimum (the point of change from deceleration to acceleration). This causes the fuel injection quantity to be undesirably decreased in the early stage of acceleration, which involves the fear of driveability and the condition of exhaust emission being deteriorated.

To overcome the above-described disadvantage, according to a second aspect of the present invention, there is provided an apparatus for controlling a fuel injection quantity for an internal combustion engine, comprising: pressure detecting means for detecting an intake-pipe pressure; first mean value detecting means for detecting a present first weighted mean value of intake-pipe pressure by using a first weighted mean value of intake-pipe pressure detected in the past and a present intake-pipe pressure and making heavier the weight given to the first weighted mean value detected in the past; second means value detecting means for detecting a present second weighted mean value of intake-pipe pressure by using a second weighted means value of intake-pipe pressure detected in the past and a present intake-pipe pressure and making the weight given to the second weighted mean value detected in the past heavier than the weight given by the first mean value detecting means; detecting means for detecting a point of change from deceleration to acceleration and vice versa; calculating means for determining an incremental/decremental quantity for the fuel injection quantity on the basis of the value obtained by subtracting the present second weighted mean value from the present first weighted mean value, the calculating means being further adapted for setting the incremental/decremental quantity to a predetermined positive value when a point of change from deceleration to acceleration is detected by the detecting means; and fuel injection means for varying the fuel injection quantity on the basis of the incremental/decremental quantity.

According to the second aspect of the present invention, a first weighted mean value PM(a) and a second weighted mean value PM(b) are detected by the first and second mean value detecting means, respectively, on the basis of the above-described equation (1), and an incremental/decremental quantity for the fuel injection quantity is calculated by the calculating means on the basis of the value obtained by subtracting the second weighted mean value PM(b) from the first weighted mean value PM(a). In addition, when a point of change from a deceleration state to an acceleration state is detected by the detecting means, the fuel injection quantity incremental/decremental amount is set to a predetermined positive value. Accordingly, even when the engine running condition is suddenly changed from deceleration to acceleration, the fuel injection quantity is effectively increased without any fear of the fuel injection quantity being decreased at a point of change from deceleration to acceleration.

As described above, according to the second aspect of the present invention, the incremental/decremental quantity for the fuel injection quantity is set to a predetermined positive value when a point of change from deceleration to acceleration is detected. It is therefore advantageously possible to improve the driveability and the condition of exhaust emission in the early stage of acceleration when the engine running condition shifts from deceleration to acceleration.

To attain the above-described object concerning asynchronous fuel injection, according to a third aspect of the present invention, there is provided a fuel injection method for an internal combustion engine, comprising the steps of: detecting a present first weighted mean value of intake-pipe pressure by using a first weighted mean value of intake-pipe pressures detected in the past and a present intake-pipe pressure and making heavier the weight given to the first weighted mean value detected in the past; detecting a present second weighted mean value of intake-pipe pressure by using a second weighted mean value of intake-pipe pressure detected in the past and a present intake-pipe pressure and making the weight given to the second weighted mean value detected in the past heavier than the weight given to the first mean value detected in the past; subtracting the present second weighted mean value from the present first weighted means value; and injecting fuel asynchronously with the crank angle when the result of the subtraction exceeds a predetermined value.

The first and second weighted mean values can be detected by carrying out calculation according to the above-described equation (1). The first weighted mean value can also be detected in such a manner that the output of a pressure sensor for detecting an intake-pipe pressure is passed through a filter having a time constant which enables removal of the pulsating component of the intake-pipe pressure. Also, the first weighted mean value can be detected by carrying out calculation according to the equation (1) using a signal output from said filter as the above-described intake-pipe pressure detected at present. More specifically, as the first weighted mean value, it is possible to employ the output of the filter as it is or a value calculated from the equation (1).

The action and effect of the third aspect of the present invention will be explained below.

When the constant K in the equation (1) is decreased (e.g., 4), a first weighted mean value $PM_1$ can be detected, whereas, when the constant K is increased, a second weighted mean value $PM_2$ can be detected. By setting the value for the constant K at an appropriate value, it is possible to detect a weighted mean value including a pulsating component of the intake-pipe pressure which has no effect on the asynchronous fuel injection, and a weighted mean value having the pulsating component of the intake-pipe pressure removed completely. The weighted mean value including the pulsating component changes promptly in response to actual changes in the intake-pipe pressure. It should be noted that, as the weighted mean value including the pulsating component, the output of the filter may be used as it is. Further, the output of the filter may be detected by setting the constant K in the equation (1) at 1. Thus, a deviation of the weighted mean value including the pulsating component from the weighted mean value having the pulsating component removed completely is calculated, and when the deviation is judged to be greater than a predetermined positive value, asynchronous fuel injection is executed, whereby it is possible to execute asynchronous fuel injection in coincidence with the start of acceleration.

As described above, it is possible, according to the third aspect of the present invention, to execute asynchronous fuel injection at the required timing without being affected by the pulsating component of the intake-pipe pressure.

The following is a description of a fourth aspect of the present invention. According to the above-described third aspect of the present invention, a filter having a relatively small time constant is employed, and a weighted mean value of intake-pipe pressure which has the pulsating component removed is calculated on the basis of the output of the filter, and when a deviation of a weighted mean value containing the pulsating component from the weighted mean value containing no pulsating component exceeds a predetermined positive value, asynchronous fuel injection is executed. According to this method, since the output of the filter changes in response to actual changes in the intake pipe pressure, the time at which acceleration is started can be detected on the basis of the size of the deviation, and asynchronous fuel injection can be started in coincidence with the start of acceleration.

However, when the running condition is shifted from deceleration to acceleration as in the case of a gear change, as shown in FIG. 2B, the filter output $PM_0$ shifts from descent to ascent at the point A (the start of acceleration) in response to an actual change in the intake-pipe pressure, whereas the weighted mean value $PM_1$ of intake-pipe pressure is delayed with respect to the filter output $PM_0$. In consequence, the deviation reaches 0 at the point B which is a predetermined period of time behind the point A, and asynchronous fuel injection is started on and after the point B. Accordingly, the air-fuel ratio becomes lean during the period from the point A to the point B, and this may deteriorate the engine performance during acceleration and the condition of exhaust emission.

Therefore, according to a fourth aspect of the present invention, there is provided a fuel injection method which enables asynchronous fuel injection to be executed without being affected by the pulsting component of the intake-pipe pressure at the timing coincident with the start of acceleration even when the engine running condition is shifted from deceleration to acceleration.

More specifically, according to the fourth aspect of the present invention, there is provided, in a fuel injection method which comprises the steps of: detecting a present first weighted mean value of intake-pipe pressure by using a first weighted mean value of intake-pipe pressure detected in the past and a present intake-pipe pressure and making heavier the weight given to the first weighted mean value detected in the past; detecting a present second weighted mean value of intake-pipe pressure by using a second weighted mean value of intake-pipe pressure detected in the past and a present intake-pipe pressure and making the weight given to the second weighted mean value detected in the past heavier than the weight given to the first mean value detected in the past; subtracting the present second weighted mean value from the present first weighted mean value; and injecting fuel asynchronously with the crank angle when the result of the subtraction exceeds a predetermined value (the method according to the third aspect of the present invention), the present first weighted mean value is set so as to be the present second weighted mean value during deceleration.

The first and second weighted mean values can be detected by carrying out calculation according to the above-described equation (1). The first weighted mean value can also be detected in such a manner that the output of a pressure sensor for detecting an intake-pipe pressure is passed through a filter having a time constant which enables removal of the pulsating component of the intake-pipe pressure. Also, the first weighted mean value can be detected by carrying out calculation according to the equation (1) using a signal output from said filter as the above-described intake-pipe pressure detected at present.

The action and effect of the fourth aspect of the present invention will be explained below.

When the constant K in the equation (1) is decreased (e.g., 4), a first weighted mean value $PM_0$ can be detected, whereas, when the constant K is increased (e.g., 16 or 32), a second weighted mean value $PM_1$ can be detected. By setting the value for the constant K at an appropriate value, it is possible to detect a first weighted mean value including a pulsating component of the intake-pipe pressure which has no effect on the asynchronous fuel injection, and a second weighted mean value having the pulsating component of the intake-pipe pressure removed completely. The first weighted mean value including the pulsating component changes promptly in response to actual changes in the intake-pipe pressure, whereas the second weighted mean value changes gently in response to actual changes in the intake-pipe pressure. Accordingly, a deviation of the first weighted mean value including the pulsating component from the second weighted mean value having the pulsating component removed completely is calculated, and a judgement is made as to whether or not the deviation exceeds a predetermined positive value (a value which exceeds the maximum value of the pulsating component based on the second weighted mean value) to detect a change in the intake-pipe pressure caused by acceleration, whereby it is possible to execute asynchronous fuel injection in coincidence with the start of acceleration. Since the first weighted mean value is set so as to be the second weighted mean value during deceleration, the first weighted mean value changes promptly in response to actual changes in the intake-pipe pressure, whereas the second weighted mean value changes gentlly in response to actual changes in the intake-pipe pressure from the time at which the engine running condition is shifted from deceleration to acceleration. For this reason, the deviation of the first weighted mean value from the second weighted mean value takes a positive value from the time at which the engine running condition is shifted from deceleration to acceleration, that is, the start of acceleration. Accordingly, the time at which the acceleration is started can be detected from the deviation, and this enables asynchronous fuel injection to be executed in coincidence with the start of acceleration when the running condition is shifted from deceleration to acceleration.

As described above, it is possible, according to the fourth aspect of the present invention, to execute asynchronous fuel injection at the required timing without being affected by the pulsating component of the intake-pipe pressure.

A fifth aspect of the present invention will be explained below. In an internal combustion engine equipped with an automatic transmission, the fuel injection quantity is increased by a predetermined amount in order to prevent occurrence of an engine stall when the shift lever is shifted from a non-drive range such as N (neutral) range or P (parking) range to a drive range such as D (drive range) or R (reverse) range during idling, since the load of the torque converter is applied to the engine when the shift lever is shifted from a non-drive range to a drive range during idling. In such internal combustion engine, the automatic transmission is automatically shifted in a transient state, and in such a case the rotational speed of the engine changes as shown in FIG. 2C, thus causing the intake-pipe pressure to repeat increase and decrease as shown in FIG. 2C. For this reason, if an apparatus for varying a fuel injection quantity on the basis of a weighted mean value according to the first aspect of the present invention and the like is applied to an internal combustion engine equipped with an automatic transmission, the above-described result of subtraction (incremental/decremental amount) repeatedly takes positive and negative values in accordance with changes in the intake-pipe pressure caused by an automatic speed change operation during deceleration. In consequence, the fuel injection quantity is repeatedly increased and decreased, and this deteriorates the condition of exhaust emission and the driveability of the engine. Such problem may be overcome by suspending the variation of the fuel injection quantity during deceleration which is defined by a state wherein the throttle valve is in a closed position. However, since a shift change of the automatic transmission, for example, from N range to D range, is generally effected in a state wherein the throttle valve is in a closed position, if the variation of the fuel injection quantity is suspended when the throttle valve is in a closed position, it is impossible to effect increment of the fuel injection quantity at the time of a shift from a non-drive range to a drive range, disadvantageously.

Therefore, according to the fifth aspect of the present invention, the fuel injection quantity is allowed to be increased at the time of a shift of the automatic transmission during idling, and is prevented from being increased during deceleration.

More specifically, according to the fifth aspect of the present invention, there is provided, in a fuel injection method for an internal combustion engine equipped with an automatic transmission, which comprises the steps of: detecting a present first weighted mean value of intake-pipe pressure using a first weighted mean value of intake-pipe pressure detected in the past and a present intake-pipe pressure and making heavier the weight given to the first weighted mean value detected in the past; detecting a present second weighted mean value of intake-pipe pressure by using a second weighted mean value of intake-pipe pressure detected in the past and a present intake-pipe pressure and making the weight given to the second weighted mean value detected in the past heavier than the weight given to the first mean value detected in the past; and varying the fuel injection quantity on the basis of a value obtained by subtracting the present second weighted mean value from the present first weighted means value, the improvement characterized in that, when the automatic transmission is shifted from a non-drive range to a drive range during idling, the fuel injection quantity is increased on the basis of the result of the subtraction, whereas, when the vehicle is running in a state wherein the throttle valve is in a closed position, the increase of the fuel injection quantity effected on the basis of the result of the subtraction is suspended.

The value obtained by subtracting the second weighted mean value PM(b) from the first weighted mean value PM(a) takes a positive value during acceleration and a negative value during deceleration as described above. Accordingly, if the fuel injection quantity is controlled on the basis of said value, the fuel injection quantity is increased during acceleration, and decreased during deceleration. When the automatic transmission is shifted from a non-drive range to a drive range during idling, if the above-described value is increased by a predetermined amount, the fuel injection quantity is increased on the basis of the increased value, thus preventing lowering of the engine output. Further, when deceleration is effected in a state wherein the throttle valve is in a closed position, that is, when the vehicle is running with the throttle valve closed, the increase of the fuel injection quantity effected on the basis of the above-described value is suspended, and the fuel injection quantity is thereby prevented from being increased in response to a change in the intake-pipe pressure caused by an automatic speed change operation.

As described above, it is possible, according to the fifth aspect of the present invention, to increase the fuel injectin quantity when the automatic transmission is shifted during idling and prevent the fuel injection quantity from being increased during deceleration. Accordingly, it is advantageously possible to improve the condition of exhaust emission and the driveability of the engine.

The above and other objects, features and advantages of the present invention will become more apparent from the following description of the preferred embodiments thereof, taken in conjunction with the accompanying drawings.

BRIEF DESCRIPTION OF THE DRAWINGS

FIG. 7 is a flowchart showing a routine in accordance with the second embodiment of the present invention;

FIGS. 8(*a*)–8(*e*) are charts showing changes in weighted mean values and the like which are employed in the second embodiment;

FIG. 11 is a flowchart showing a main routine in accordance with the fourth embodiment of the present invention;

FIGS. 12(*a*)–12(*e*) are charts showing changes in weighted mean values and the like which are employed in the fourth embodiment;

DESCRIPTION OF THE PREFERRED EMBODIMENTS

Figure 1:
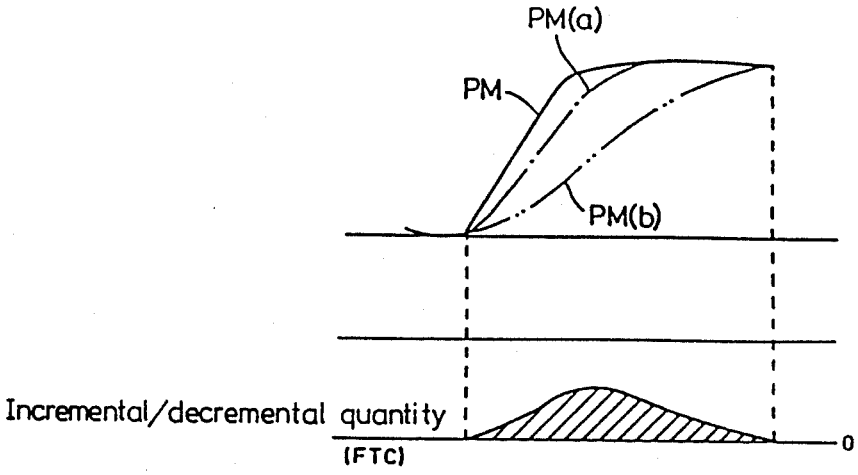
FIG. 1 is a chart employed to describe the principle of the present invention.
Figure 2A:
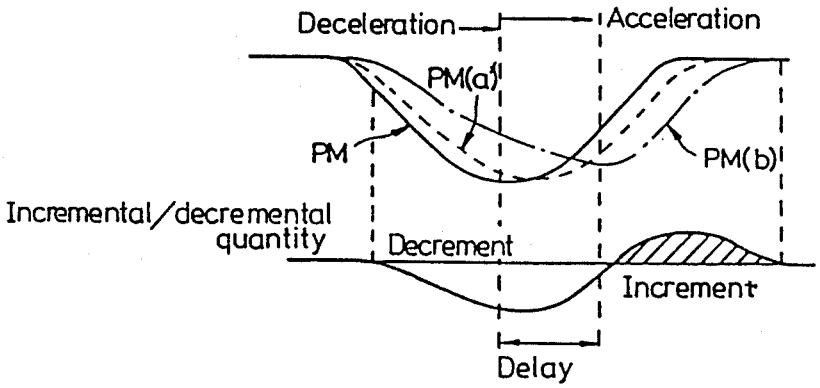
FIG. 2A is a chart employed to describe the delay in increment of the fuel injection quantity when the engine running condition is shifted from deceleration to acceleration.
Figure 2B:
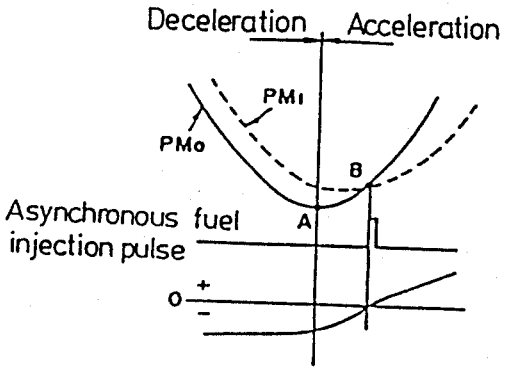
FIG. 2B is a chart showing the timing of an asynchronous fuel injection pulse signal.

The present invention may be carried out in the following practical forms.

In a first practical form, the calculating means according to the second aspect of the present invention is adapted to determine an incremental/decremental quantity for the fuel injection quantity on the basis of a value obtained by subtracting a second weighted mean value of intake-pipe pressure detected at present from a first weighted mean value of intake-pipe pressure detected at present and to set the incremental/decremental quantity at a predetermined negative value when a point of change from acceleration to deceleration is detected by the detecting means. According to this practical form, when a point of change from acceleration to deceleration is detected, the incremental/decremental quantity is set at a predetermined negative value to decrease the fuel injection quantity, and it is therefore possible to improve the driveability and the condition of exhaust emission in the early stage of deceleration when the engine running condition is shifted from acceleration to deceleration.

In a second practical form, the calculating means according to the second aspect of the present invention is adapted to determine an incremental/decremental quantity for the fuel injection quantity on the basis of a value obtained by subtracting a second weighted mean value of intake-pipe pressure detected at present from a first weighted mean value of intake-pipe pressure detected at present and to set the incremental/decremental quantity at zero when a point of change from acceleration to deceleration and vice versa is detected by the detecting means. According to this practical form, when a point of change from acceleration to deceleration and vice versa is detected by the detecting means, the increment or decrement is set at zero, and this enables the increment or decrement of the fuel injection quantity to be started from the point of change from deceleration to acceleration or from acceleration to deceleration. Thus, it is possible to improve the driveability and the condition of exhaust emission.

In a third practical form, the change point detecting means according to the second aspect of the present invention is adapted to detect the above-described point of change on the basis of both a third weighted mean value which is detected in accordance with a weight which is set so as to be intermediate between those which are given to the first and second weighted mean values, respectively, and in accordance with a present intake-pipe pressure, and a value which changes substantially proportional to the intake-pipe pressure. According to this practical form, size comparision is made between a value PM(c) which changes substantially proportional to the intake-pipe pressure PM and the third weighted mean value PM(d), and a point of time at which the condition has changed from $PM(c)<PM(d)$ to $PM(c)>PM(d)$ is detected to be a point of change from deceleration to acceleration, whereas a point of time at which the condition has changed from $PM(c)>PM(d)$ to $PM(c)<PM(d)$ is detected to be a point of change from acceleration to deceleration.

In a fourth practical form, the change point detecting means according to the second aspect of the present invention is adapted to detect the above-described point of change on the basis of both a past intake-pipe pressure and a present intake-pipe pressure. According to this practical form, a past intake-pipe pressure $PM_{i-1}$ and a present intake-pipe pressure $PM_i$ are compared with each other, and a point of time at which the condition has changed from $PM_i<PM_{i-1}$ to $PM_i>PM_{i-1}$ is detected to be a point of change from deceleration to acceleration, whereas a point of time at which the condition has changed from $PM_i>PM_{i-1}$ to $PM_i<PM_{i-1}$ is detected to be a point of change from acceleration to deceleration.

As described above, it is possible, according to the third and fourth practical forms, to detect fairly accurately a point of change from deceleration to acceleration and vice versa.

Practical embodiments of the present invention will be described hereinunder in detail with reference to the accompanying drawings.

Figure 3:
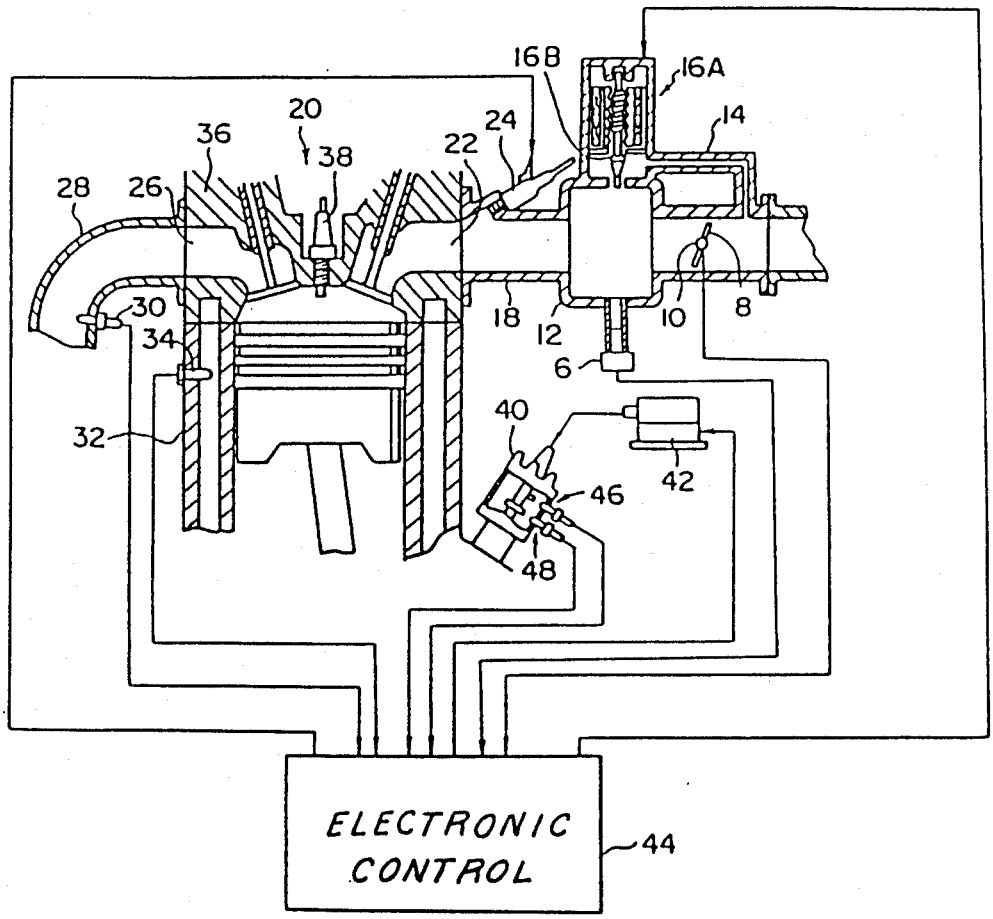
FIG. 3 schematically shows an engine to which first to fifth embodiments of the present invention may be applied.

FIG. 3 schematically shows an internal combustion engine (hereinafter refered to as an "engine") which may be equipped with a fuel injection quantity control apparatus in accordance with each of the first to fifth embodiments of the present invention.

The engine is controlled by an electronic control circuit such as a microcomputer. A throttle valve 8 is disposed on the downstream side of an air cleaner (not shown). The throttle valve 8 is equipped with an idling switch 10 which is adapted to turn ON when the throttle valve 8 is in a full closing position (idling position). A surge tank 12 is provided on the downstream side of the throttle valve 8. A diaphragm-type pressure sensor 6 is mounted on the surge tank 12. The pressure sensor 6 incorporates a filter such as a CR filter which has a relatively small time constant (e.g., 3 to 5 msec) for the purpose of removing a pulsating component of the intake pipe pressure and which has excellent response. This filter may be provided between the pressure sensor 6 and a control circuit described later (see FIG. 15). A bypass passage 14 is provided so as to bypass the throttle valve 8 and to provide communication between the upstream side of the throttle valve 8 and the surge tank 12. An ISC valve 16B is provided in the bypass passage 14, the degree of opening of the valve 16B being adjusted by a pulse motor 16A having a four-pole stator. The surge tank 12 is communicated with the combustion chamber of an engine 20 through an intake manifold 18 and an intake port 22. A fuel injection valve 24 which is provided for each cylinder or each cylinder group is disposed so as to project into the intake manifold 18.

The combustion chamber of the engine 20 is communicated with a catalyst device (not shown) which is filled with a ternary catalyst through an exhaust port 26 and an exhaust manifold 28. An $O_2$ sensor 30 is provided on the exhaust manifold 28, the sensor 30 being adapted to output a signal which is inverted in accordance with a stoichiometric air-fuel ratio employed as a boundary. A cooling water temperature sensor 34 is provided on an engine block 32 in such a manner that the sensor 34 extends through the outer wall of the engine block 32 and projects into a water jacket. The sensor 34 detects the temperature of water for cooling the engine 20 and outputs a cooling water temperature signal.

An ignition plug 38 which is provided for each cylinder is provided on a cylinder head 36 in such a manner that the distal end of the ignition plug 38 extends through the wall of the cylinder head 36 and projects into the combustion chamber of the engine 20. The ignition plug 38 is connected to an electronic control circuit 44 which is defined by, for example, a microcomputer, through a distributor 40 and an ignitor 42. The distributor 40 is provided with a cylinder identification sensor 46 and a rotational angle sensor 48 each constituted by a combination of a signal rotor rigidly secured to the shaft of the distributor 40 and a pickup rigidly secured to the distributor housing. The cylinder identification sensor 46 outputs a cylinder identification signal, e.g., every crank angle of 720°, and the rotational angle sensor 48 outputs an engine speed signal, e.g., every crank angle of 30°.

Figure 4:
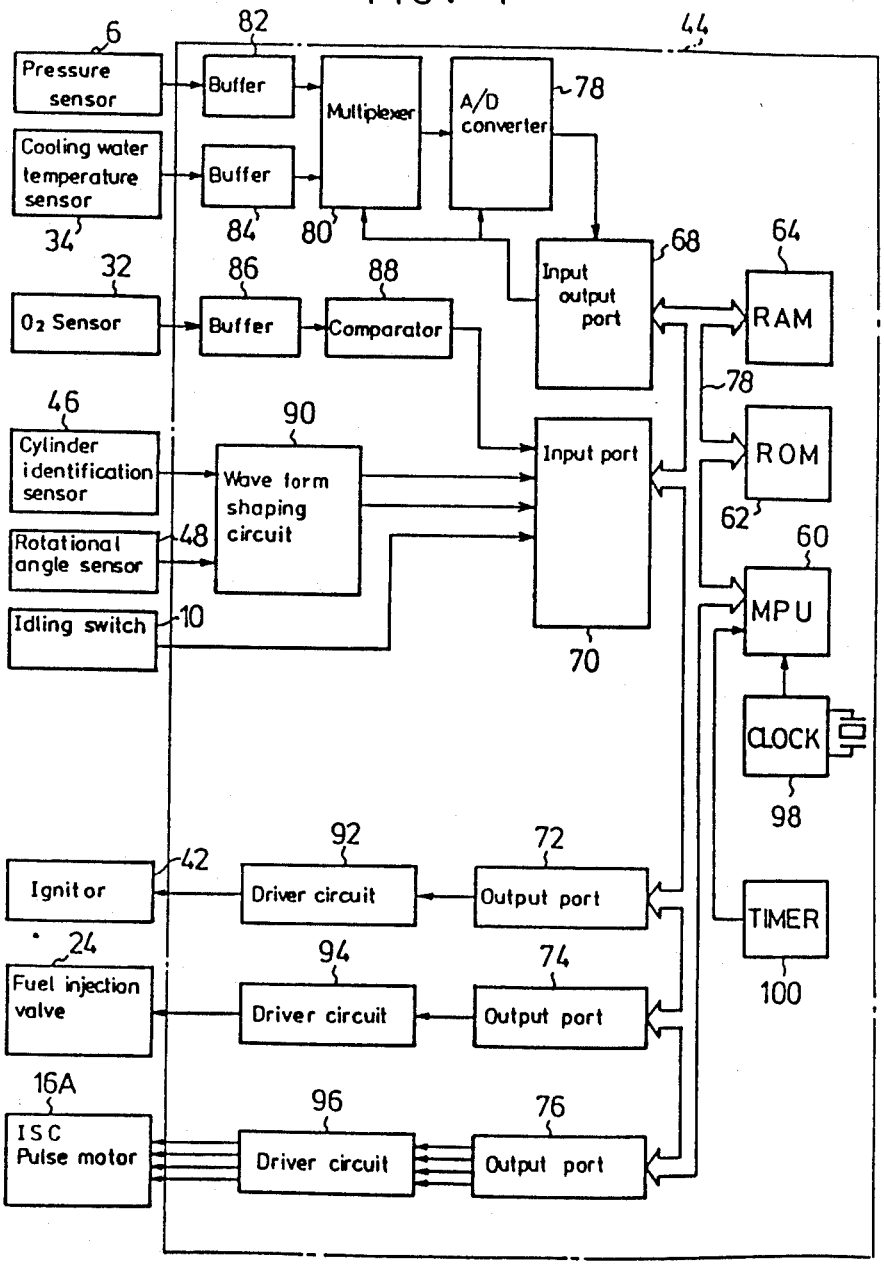
FIG. 4 is a block diagram of the control circuit shown in FIG. 3.

Referring to FIG. 4, the electronic control circuit 44 includes a central processing unit (MPU) 60, a read-only memory (ROM) 62, a random-access memory (RAM) 64, a backup RAM (BU-RAM) 66, an input-/output port 68, an input port 70, output ports 72, 74, 76, and buses 78 for interconnecting these elements, such as a data bus and a control bus. To the input/output port 68 are connected the pressure sensor 6 and the cooling water temperature sensor 34 through an analog-to-digital (A/D) converter 78, a multiplexer 80 and buffers 82, 84. The MPU 60 controls the multiplexer 80 and the A/D converter 78 so that signals output from the pressure sensor 6 which are processed by the filter and signals output from the cooling water temperature sensor 34 are successively converted into digital signals and then stored in the RAM 64. Thus, the multiplexer 84, the A/D converter 78, the MPU 60, etc. serve in combination as sampling means for sampling the output of the pressure sensor 6 every predetermined period of time. The $O_2$ sensor 30 is connected to the input port 70 through a comparator 38 and a buffer 86, and the cylinder identifiation sensor 46 and the rotational angle sensor 48 are also connected to the input port 70 through a waveform shaping circuit 90. Further, the idling switch 10 is connected to the input port 70. The output port 72 is connected to the ignitor 42 through a driver circuit 92, while the output port 74 is connected to the fuel injection valve 24 through a driver circuit 94, and the output port 76 is connected to the pulse motor 16A of the ISC valve 16B through a driver circuit 96. It should be noted that the reference numerals 98 and 100 denote a clock and a timer, respectively. The ROM 62 has stored therein in advance various data and programs for routines described below The following is a description of embodiments in which the present invention is applied to the above-described engine, and weighted mean values are detected by calculation. Control routines in accordance with the first embodiment will first be explained. Although the embodiments will be explained below using numerical values which may be employed in the present invention without any hindrance, it should be noted that the present invention is not necessarily restricted to these numerical values.

Figure 5:
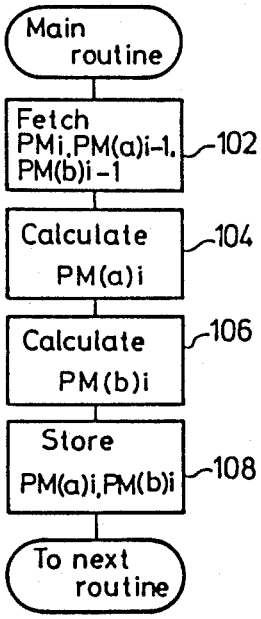
FIGS. 5 and 6 are flowcharts showing routines in accordance with the first embodiment of the present invention.

Referring to FIG. 5, which shows a part of the main routine in accordance with this embodiment, the following data items are fetched in Step 102: namely, a present intake-pipe pressure $PM_i$ of intake-pipe pressure which is A/D converted every predetermined period of time, for example, every 4 msec or 2 msec and stored in the RAM 64; and a first weighted mean value $PM(a)_{i-1}$ and a second weighted means value $PM(b)_{i-1}$ which have been calculated previously and stored in the RAM 64. A present first weighted mean value $PM(a)_i$ and a present second weighted mean value $PM(b)_i$ are respectively calculated in Steps 104 and 106 according to the following equations:

$$PM(a)_i = \frac{PM_i + 3PM(a)_{i-1}}{4} \quad (2)$$

$$PM(b)_i = \frac{PM_i + 63PM(b)_{i-1}}{64} \quad (3)$$

The calculated $PM(a)_i$ and $PM(b)_i$ are stored in the RAM 64 in place of the previous weighted mean values $PM(a)_{i-1}$ and $PM(b)_{i-1}$, respectively, in Step 108.

Figure 6:
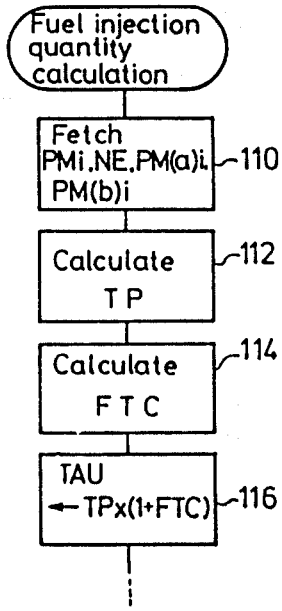

FIG. 6 shows an interruption routine which is executed in response to an interruption signal which is generated by the rotational angle sensor 48 (the signal being generated, e.g., every revolution of the crankshaft). The present intake-pipe pressure $PM_i$, the engine speed NE and the weighted mean values $PM(a)_i$, $PM(b)_i$, which have been stored in the RAM 64, are fetched in Step 110, and a basic fuel injection quantity TP is calculated in Step 112 on he basis of both the intake-pipe pressure $PM_i$ or $PM(a)_i$ and the engine speed NE and in a manner similar to that in the conventional method. In Step 114, the second weighted mean value $PM(b)_i$ is subtracted from the first weighted means value $PM(a)_i$, and the result $\Delta PM$ of the subtraction is then multiplied by a constant A to calculate an incremental/decremental coefficient FTC for the fuel injection quantity. Then, a target fuel injection quantity TAU is calculated in Step 116 according to the following equation:

$$TAU = TP \cdot (1 + FTC) \cdot FAF \quad (4)$$

The reference symbol FAF in the equation (4) denotes an air-fuel ratio feedback correction coefficient employed for controlling the air-fuel ratio to a stoichiometric level on the basis of the output of the $O_2$ sensor 32.

After the fuel injection quantity TAU has been calculated as described above, the driver circuit 94 is controlled in accordance with a fuel injection routine (not shown) so as to open the fuel injection valve 24 for a period of time corresponding to the fuel injection quantity TAU, thus executing fuel injection. Since the incremental/decremental coefficient FTC changes as shown in FIG. 1, the fuel injection quantity is controlled during acceleration so that it is gradually increased from the beginning to the end of acceleration. During deceleration, on the other hand, the incremental/decremental coefficient FTC takes a negative value, and therefore the fuel injection quantity is controlled so as to decrease gradually from the beginning to the end of deceleration.

The second embodiment of the present invention will be explained below with reference to FIGS. 7 and 8. Since an engine to which this embodiment may be applied and the fuel injection quantity calculating routine are similar to those shown in FIGS. 3, 4 and 6, description thereof is omitted. This embodiment corresponds to the first, second and fourth practical forms of the present invention. In FIG. 7, the same Steps as those shown in FIG. 5 are denoted by the same reference numerals, and description thereof is omitted.

In Step 118, an intake-pipe pressure $PM_{i-1}$ which has been A/D converted previously and stored in the RAM 64 is fetched, and a present intake-pipe pressure $PM_i$ which has been stored in the RAM 64 and the previous intake-pipe pressure $PM_{i-1}$ are compared with each other in Step 120. Since the intake-pipe pressure $PM_{i-1}$ is delayed with respect to the intake-pipe pressure $PM_i$ by a sampling period (e.g., 4 msec), the intake-pipe pressures $PM_i$ and $PM_{i-1}$ change as shown in FIG. 8(*a*). The difference, that is, the result of $PM_i - PM_{i-1}$, changes as shown in FIG. 8(*b*), and reaches zero when the intake-pipe pressure $PM_i$ becomes substantially minimum. When it is judged in Step 120 that the condition of $PM_i \leqq PM_{i-1}$ is met, a judgement is made in Step 122 as to whether or not a flag F is reset. If YES, the subsequent routine is then executed, If the answer in Step 122 is NO, the flag F is reset in Step 124, and a value obtained by adding a predetermined value $\alpha$ to the first weighted mean value $PM(a)_i$ is set so as to be a value for the second weighted mean value $PM(b)_i$ If it is judged in Step 120 that the condition of $PM_i > PM_{i-1}$ is met, a judgement is made in Step 128 as to whether or not the flag F is set. If YES, the subsequent routine is then executed, whereas, if the answer in Step 128 is NO, the flag F is set in Step 130, and a value obtained by subtracting a predetermined value $\alpha$ from the first weighted mean value $PM_i$ is set so as to be a value for the second weighted mean value $PM(b)_i$ in Step 132.

As a result, the flag F is set when $PM_i > PM_{i-1}$, and reset when $PM_i \leqq PM_{i-1}$, as shown in FIG. 8(*c*). The weighted mean value $PM(b)_i$ is, as shown in FIG. 8(*d*), made equal to $PM(a)_i - \alpha$ when $PM_i > PM_{i-1}$ and the flag F is reset, that is, at a point of change from deceleration to acceleration, and $PM(b)_i$ is made equal to $PM(a)_i + \alpha$ when $PM_i \leqq PM_{i-1}$ and the flag F is set, that is, at a point of change from acceleration to deceleration. Then, an incremental/decremental coefficient FTC is calculated in Step 114 shown in FIG. 6 on the basis of a value obtained by subtracting the $PM(b)_i$ thus calculated from $PM(a)_i$. Accordingly, the incremental/decremental coefficient FTC is set to $A\alpha$ at a point of change from deceleration to acceleration, and set to $A\alpha$ at a point of change from acceleration to deceleration.

Thus, it is possible, according to this embodiment, to vary the fuel injection quantity in conformity with an actual acceleration or deceleration condition. Since the difference between the weighted mean values $PM(a)_i$ and $PM(b)_i$ is set to a constant value ($\pm\alpha$) at a point of change from deceleration to acceleration or vice versa, the weighted mean value PM(b) which is relatively inferior in terms of response is calculated from a value which is a predetermined value larger than the weighted mean value PM(a) which is relatively superior in terms of response, so that it is possible to prevent occurrence of undershoot of the increment of the fuel injection quantity in the early stage of acceleration when the engine running condition shifts from deceleration to acceleration, or overshoot of the decrement of the fuel injection quantity in the early stage of deceleration when the engine running condition shifts from acceleration to deceleration. Thus, even when the engine is in a quick transient state, the air-fuel ratio of the air-fuel mixture supplied to the engine is allowed to approach the value required by the engine, thereby smoothing the air-fuel ratio. Further, it is possible to prevent deterioration of the condition of exhaust emission when the engine is in a quick transient state.

Figure 9:
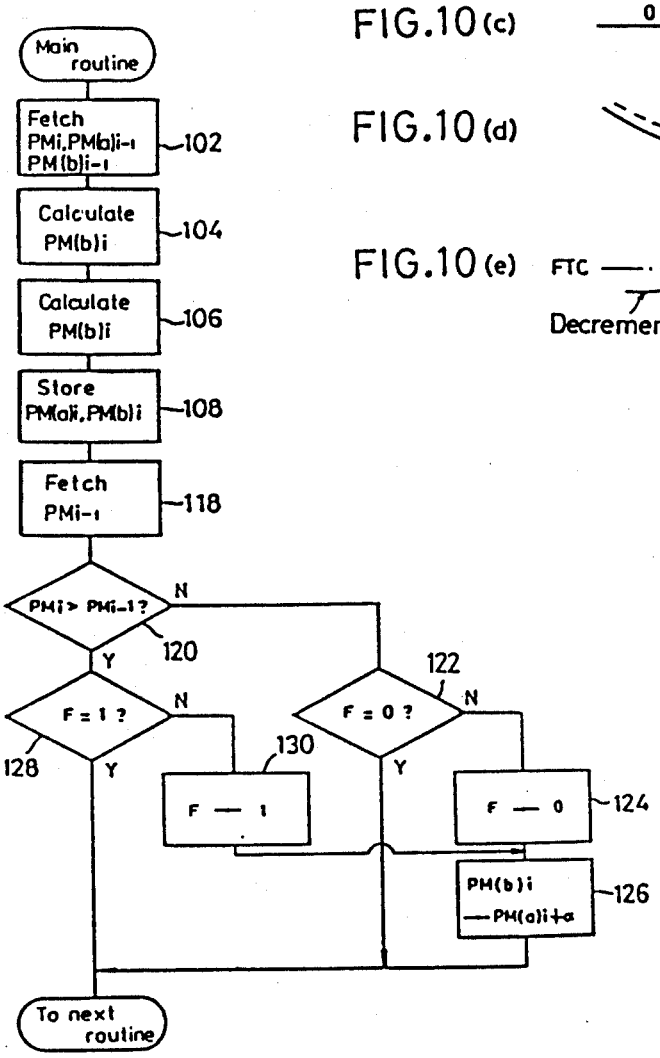
FIG. 9 is a flowchart showing a main routine in accordance with the third embodiment of the present invention.
Figure 10:
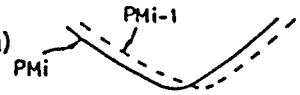
FIGS. 10(*a*)–10(*e*) are charts showing changes in weighted mean values and the like which are employed in the third embodiment.
Figure 10:
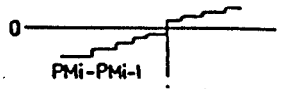
Figure 10:
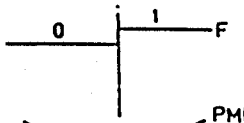
Figure 10:
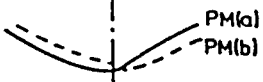
Figure 10:
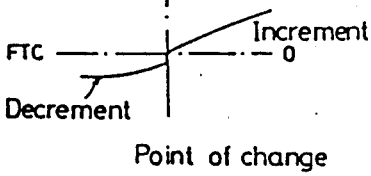

The third embodiment of the present invention will be explained below with reference to FIGS. 9 and 10. Since an engine to which this embodiment may be applied and the fuel injection quantity calculating routine are similar to those shown in FIGS. 3, 4 and 6, description thereof is omitted. This embodiment corresponds to the third practical form of the present invention. In FIG. 9, the same Steps as those shown in FIG. 7 are denoted by the same reference numerals, and description thereof is omitted.

In this embodiment, when a point of change from deceleration to acceleration is detected in Step 122 shown in FIG. 9, or when a point of change from acceleration to deceleration is detected in Step 128, the second weighted mean value $PM(b)_i$ is made equal to the first weighted mean value $PM(a)_i$ in Step 134. As a result, the second weighted mean value $PM(b)_i$ changes as shown in FIG. 10(*d*). When the engine running condition shifts from deceleration to acceleration, the incremental/decremental coefficient FTC becomes zero at a point of change from deceleration to acceleration, and the increment of the fuel injection quantity gradually increases from the point of change as shown in FIG. 10(*e*). On the other hand, the incremental/decremental coefficient FTC becomes zero at a point of change from acceleration to deceleration, and the decrement of the fuel injection quantity gradually increases from the point of change.

As described above, the weighted mean values $PM(a)_i$ and $PM(b)_i$ are made equal to each other at a point of change from deceleration to acceleration and vice versa. Therefore, the weighted mean value PM(b) which is relatively inferior in terms of response is calculated from a value which is a predetermined value larger than the weighted mean value PM(a) which is relatively superior in terms of response, so that it is possible to prevent occurrence of undershoot of the increment of the fuel injection quantity in the early stage of acceleration when the engine running condition shifts from deceleration to acceleration, or overshoot of the decrement of the fuel injection quantity in the early stage of deceleration when the engine running condition shifts from acceleration to deceleration. Thus, even when the engine is in a quick transient state, the air-fuel ratio of the air-fuel mixture supplied to the engine is allowed to approach the value required by the engine, thereby smoothing the air-fuel ratio. Further, it is possible to prevent deterioration of the condition of exhaust emission when the engine is in a quick transient state.

Although in this embodiment the value of $PM(a)_i$ is set so as to be a value for $PM(b)_i$ at a point of change from deceleration to acceleration and vice versa, the value of $PM(b)_i$ may be set as a value for $PM(a)_i$, conversely.

The fourth embodiment of the present invention will be explained below with reference to FIGS. 11 and 12. Since an engine to which this embodiment may be applied and the fuel injection quantity calculating routine are similar to those shown in FIGS. 3, 4 and 6, description thereof is omitted. This embodiment corresponds to the second and third practical forms of the present invention. In FIG. 11, the same Steps as those shown in FIG. 9 are denoted by the same reference numerals, and description thereof is omitted.

In Step 136, the following various data items are fetched: a presently sampled intake-pipe pressure $PM_i$ and weighted mean values $PM(a)_{i-1}$, $PM(b)_{i-1}$, $PM(c)_{i-1}$ and $PM(d)_{i-1}$ which have been calculated previously and stored in the RAM 64. Weighted mean values $PM(a)_i$ and $PM(c)_i$ are calculated in Step 138, while weighted mean values $PM(b)_i$ and $PM(d)_i$ are calculated in Step 140, and these weighted mean values are stored in the RAM 64 in Step 142. The respective constants Ka and Kb for the weighted mean values $PM(a)_i$ and $PM(b)_i$, which correspond to the constant K in the above-described equation (1), are determined to be 4 and 64, respectively. The constant Kc for the weighted mean value $PM(c)_i$ is determined to be 4 or less, while the constant Kd for the weighted mean value $PM(c)_i$ is determined to be a value intermediate between Ka and Kb, and it can be calculated, for example, according to the equation (6) described below. More specifically, the constants Ka, Kb, Kc and Kd are set so as to satisfy the following relationship:

$$1 \leqq Kc \approx Ka < Kd < Kb \quad (5)$$

Accordingly, when the engine running condition shifts from deceleration to acceleration, the weighted mean values PM(c) and PM(d) change as shown in FIG. 12(*a*).

In Step 144, size comparison is made between weighted mean values $PM(c)_i$ and $PM(d)_i$ which have been calculated this time, and when $PM(c)_i > PM(c)_i$, the process proceeds to Step 128, whereas, when $PM(c)_i \leqq PM(c)_i$, the process proceeds to Step 122. Then, the weighted mean values $PM(b)_i$ and $PM(a)_i$ are made equal to each other in Step 134 in a manner similar to the above. As a result, at a point of change from deceleration to acceleration, the weighted mean value PM(a) changes as shown in FIG. 12(*d*). In consequence, the incremental/decremental coefficient FTC changes as shown in FIG. 12(*e*), so that the increment of the fuel injection quantity gradually increases from the point of change. On the other hand, the incremental/decremental coefficient FTC becomes zero at a point of change from acceleration to deceleration, and the decrement of the fuel injection quantity gradually increases from the point of change.

Although in this embodiment the incremental/decremental coefficient FTC is made zero at a point of change from deceleration to acceleration and vice versa, FTC may be set to a predetermined positive value at a point of change from deceleration to acceleration, and set to a predetermined negative value at a point of change from acceleration to deceleration, as in the case of the above-described second embodiment.

The fifth embodiment of the present invention will be explained below.

As has already been described, the amount of adhesion of fuel to the inner wall of the intake pipe varies with changes in the intake-pipe pressure during acceleration (or deceleration), and it also varies with changes in the engine temperature. More specifically, when the engine temperature, e.g., the temperature of water for cooling the engine or the temperature of engine oil, is relatively low, the rate of evaporation of fuel is relatively low, and therefore the amount of adhesion of fuel to the inner wall of the intake pipe is increased. On the other hand, when the engine temperature is relatively high, the rate of evaporation of fuel is relatively high, so that the amount of adhesion of fuel is decreased. Therefore, in this embodiment, the increment of the fuel injection quantity is made smaller in the case of a relatively high engine temperature than in the case of a relatively low engine temperature. Since an engine and a main routine to which this embodiment may be applied are similar to those shown in FIGS. 3 and 5, illustration thereof is omitted. Steps shown in FIG. 13 which correspond to those shown in FIG. 6 are denoted by the same reference numerals, and description thereof is omitted.

Figure 13:
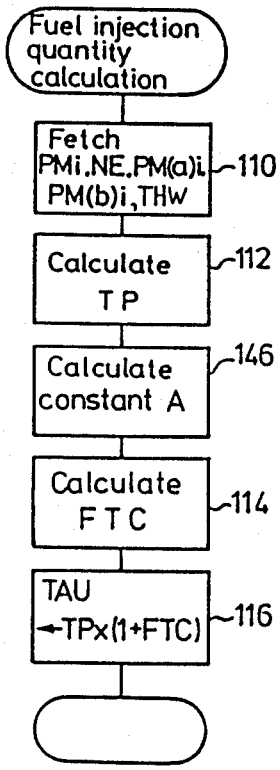
FIG. 13 is a flowchart showing a routine in accordance with the fifth embodiment of the present invention.
Figure 14:
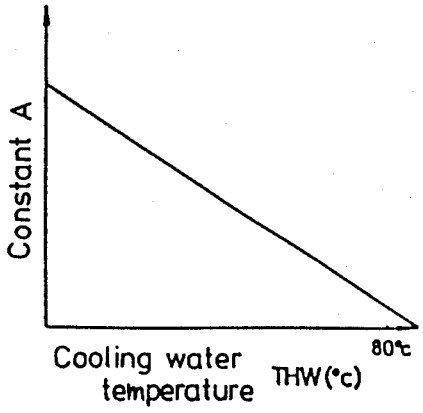
FIG. 14 is a chart showing a map of the constant A which is employed in the fifth embodiment.

Referring to FIG. 13, after a basic fuel injection quantity has been calculated, the process proceeds to Step 146, in which a constant A which corresponds to a present engine temperature such as an engine cooling water temperature THW is calculated from a map shown in FIG. 14. The constant A is set so as to decrease as the engine cooling water temperature THW rises. Then, an incremental/decremental coefficient FTC for the fuel injection quantity is obtained on the basis of the constant A, and a target fuel injection quantity TAU is obtained in a manner similar to that described above.

Since the constant A varies with changes in the temperature of water for cooling the engine, the increment of the fuel injection quantity is larger in the case of a relatively low engine cooling water temperature than in the case of a relatively high engine cooling water temperature. In consequence, even when the engine cooling water temperature changes, the air-fuel ratio of the air-fuel mixture supplied to the combustion chamber of the engine is maintained at a substantially constant level, so that it is possible to improve the driveability and the condition of exhaust emission.

It should be noted that this embodiment may be applied to the above-described second to fourth embodiments. Although in the described embodiments weighted mean values are detected by calculation, first and second weighted mean values may be respectively detected using two filters having different time constants.

A sixth embodiment of the present invention will be explained below.

In this embodiment, the present invention is applied to a system in which fuel is injected asynchronously with the crank angle, that is, fuel injection is carried out independently of the crank angle.

Figure 15:
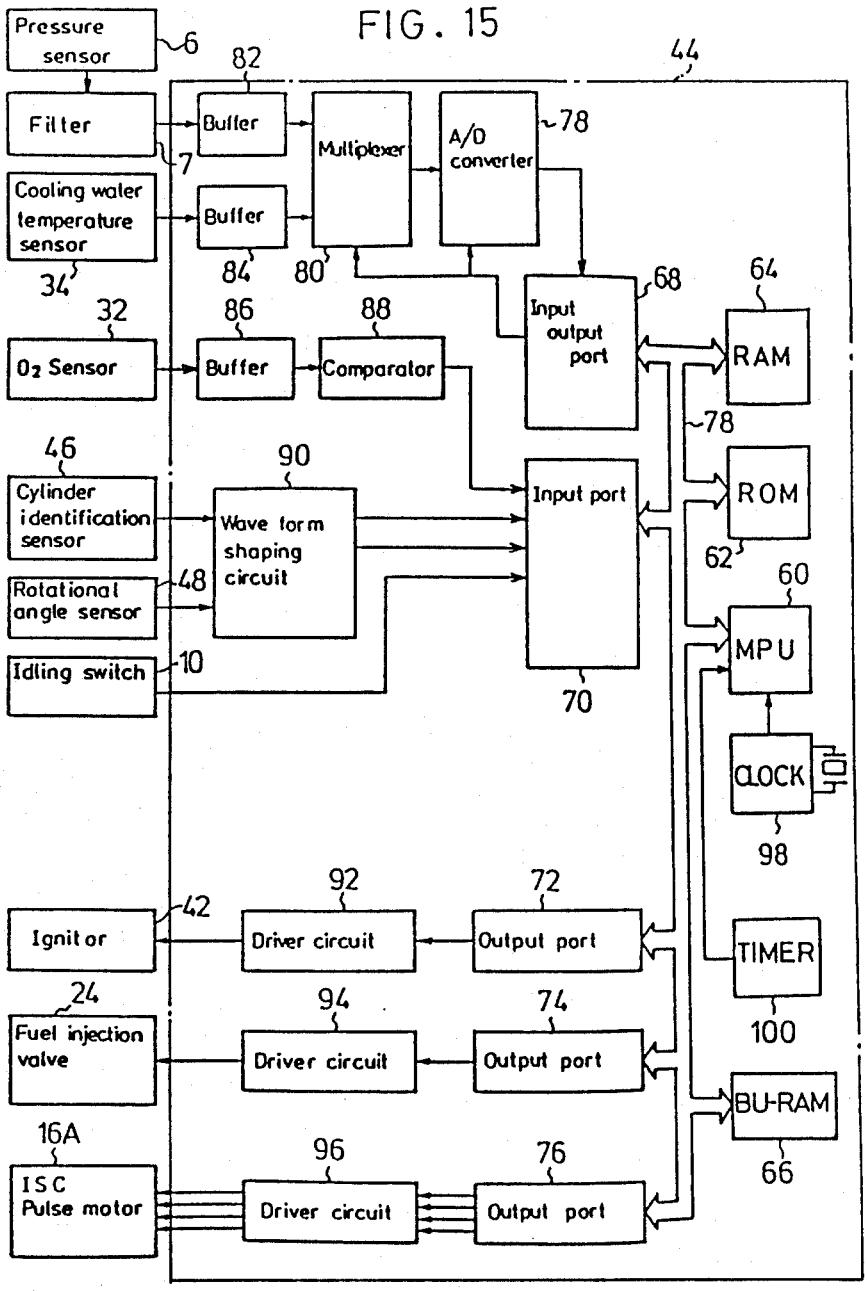
FIG. 15 is a block diagram showing in detail a control circuit in accordance with a sixth embodiment of the present invention.

Since an engine to which this embodiment may be applied is similar to that shown in FIG. 3, description thereof is omitted. Further, since the arrangement of a control circuit shown in the block diagram of FIG. 15 is similar to that shown in FIG. 4, the same portions and elements are denoted by the same reference numerals, and description thereof is omitted. Description will be made only about portions or members which are different from those in the arrangement shown in FIG. 4.

Referering to FIG. 15, the pressure sensor 6 which is attached to the surge tank 12 is defined by a semiconductor strain resistance type pressure sensor. To the pressure sensor 6 is connected a filter 7 having a time constant of about 3 to 5 msec. More specifically, the filter 7, the pressure sensor 6 and the cooling water temperature sensor 34 are connected to the input/output port 68 through the A/D converter 78, the multiplexer 80 and the buffers 82, 84.

The arrangement of the other part of the control circuit 44 is the same as that in the above-described first to fifth embodiments.

The control routine in accordance with this embodiment will be explained below.

Figure 16:
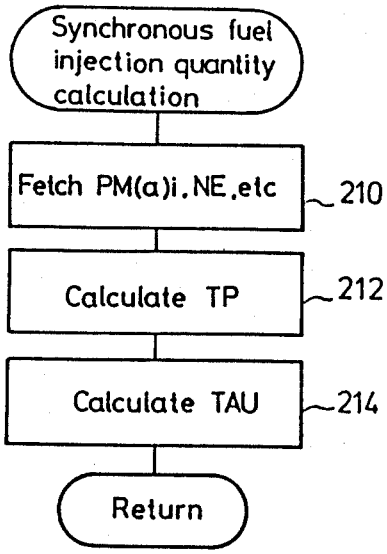
FIG. 16 is a flowchart showing a synchronous fuel injection quantity calculating routine in accordance with the sixth embodiment.

FIG. 16 shows a synchronous fuel injection quantity calculating routine in accordance with this embodiment which is executed every crank angle of 360°. In Step 210, various data items are fetched, such as a weighted mean value $PM(a)_i$ of intake-pipe pressure PM which has been input to the control circuit 44 from the pressure sensor 6 through the filter 7, A/D converted and stored in the RAM 64, an engine speed NE, etc. A basic injection duration which corresponds to a basic fuel injection quantity TP is calculated in Step 212 on the basis both the weighted mean value $PM(a)_i$ and the engine speed NE. The calculated basic injection during corresponding to the basis fuel injection quantity TP is corrected in Step 214 in accordance with an air-fuel ratio feedback correction coefficient obtained on the basis of the output of the $O_2$ sensor 30, an intake-air temperature and an engine cooling water temperature to obtain a target injection duration corresponding to the fuel injection quantity TAU. Then, the fuel injection valve 24 is opened to inject fuel for a period of time corresponding to the fuel injection quantity TAU in synchronism with the crank angle (e.g., the top dead center during intake stroke) in accordance with a fuel injection quantity control routine (not shown).

Figure 17:
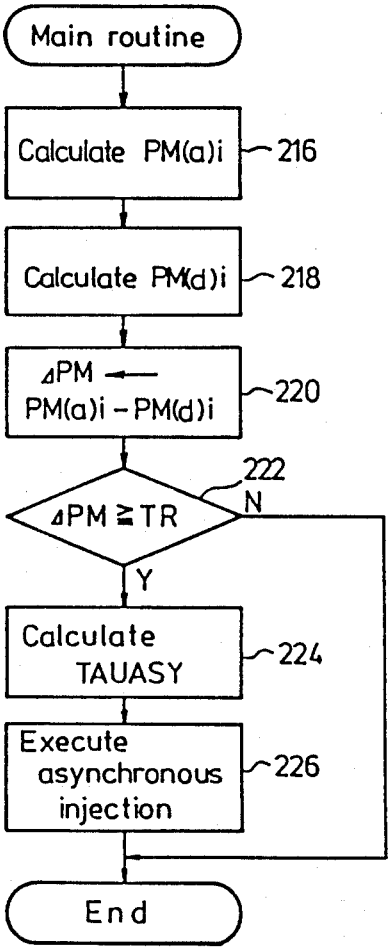
FIG. 17 is a flowchart showing a main routine in accordance with the sixth embodiment.

Referring to FIG. 17, which shows a main routine in accordance with this embodiment which is executed every 4 msec, a present intake-pipe pressure $PM_i$ of intake-pipe pressure which is A/D converted every predetermined period of time and stored in the RAM 64 and a first weighted mean value $PM(a)_{i-1}$ which has been calculated previously and stored in the RAM 64 are fetched in Step 216, and a present first weighted mean value $PM(a)_i$ is calculated according to the above-described equation (2).

The weighted mean value $PM(a)_i$ contains a pulsating component of relatively low level.

In Step 218, a present intake-pipe pressure $PM_i$ and a second weighted means value $PM(d)_{i-1}$ which has been calculated previously and stored in the RAM 64 are fetched, and a present second weighted mean value $PM(c)_i$ is calculated according to the following equation:

$$PM(\mathrm{d})_i = \frac{PM_i + 31PM(d)_{i-1}}{32} \tag{6}$$

The weighted mean value $PM(c)_i$ has the pulsating component completely removed therefrom. It should be noted that this routine may be executed every time a detected intake-pipe pressure is A/D converted, or at an interval of time which is shorter than the interval of A/D conversion of intake-pipe pressure.

Figure 18:
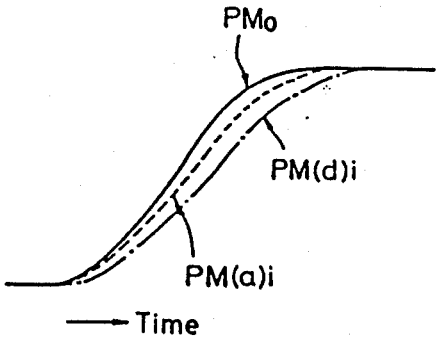
FIG. 18 is a chart showing changes in the filter output $PM_0$ and first and second weighted mean values which are employed in the sixth embodiment.

FIG. 18 shows changes in the weighted mean values $PM(a)_i$ and $PM(d)_i$ thus calculated and the intake-pipe pressure $PM_0$ (filter output).

In Step 220, the second weighted mean value $PM(c)_i$ is subtracted from the first weighted mean value $PM(a)_i$ to obtain a deviation ΔPM, and the deviation ΔPM and a predetermined positive value TR are compared with each other in Step 222. If the deviation ΔPM is judged to be not smaller than the value TR in Step 222, it is judged that there is a demand for asynchronous fuel injection, and a target asynchronous fuel injection quantity TAUASY is calculated in Step 224 according to the following equation:

$$\mathrm{TAUASY} = k \cdot \Delta PM \tag{7}$$

where k is a constant.

Then, the fuel injection valve 24 is opened for a period of time corresponding to the asynchronous fuel injection quantity TAUASY to execute asynchrnous fuel injection in Step 226. It it is judged in Step 222 that the deviation ΔPM is less than the value TR, the process returns to the main routine. It should be noted that the asynchronous fuel injection quantity TAUASY may be a predetermined value.

As a result, asynchronous fuel injection is executed when the deviation ΔPM exceeds the predetermined value TR. Since the first weighted mean value $PM(a)_i$ is substantially proportional to the output of the pressure sensor 6, the pulsating component of the intake-pipe pressure cannot completely be removed from the mean value $PM(a)_i$. However, in this embodiment the first weighted mean value $PM(a)_i$ is compared with the second weighted mean value $PM(d)_i$ which varies gently in response to changes in the intake-pipe pressure, whereby a change in intake-pipe pressure caused by the pulsating component and acceleration appears as a deviation ΔPM. Therefore, it is possible to make a judgement as to whether or not acceleration has been started by setting the value TR at a value which is greater than the maximum value of the pulsating component. Thus, asynchronous fuel injection can be executed at the same time as the start of acceleration.

Figure 19:
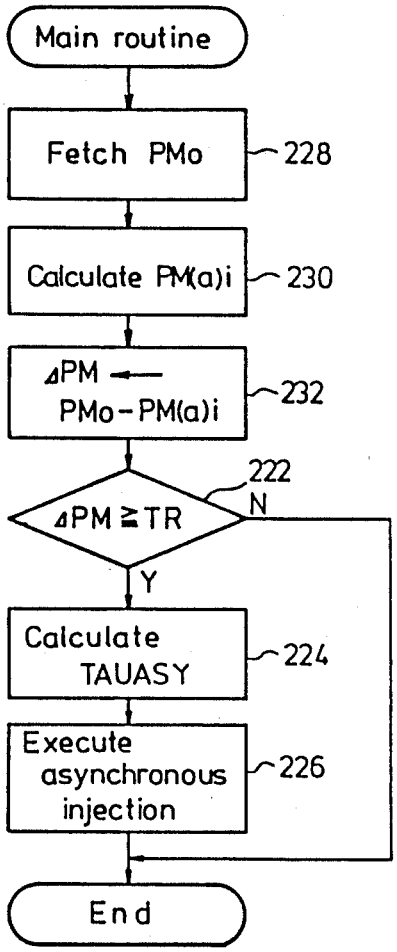
FIG. 19 is a flowchart showing a main routine in accordance with a seventh embodiment of the present invention.

FIG. 19 shows a main routine in accordance with a seventh embodiment of the present invention. Since an asynchronous fuel injection quantity calculating routine in accordance with this embodiment is similar to that in the sixth embodiment, description thereof is omitted, and since the main routine shown in FIG. 19 is substantially the same as that shown in FIG. 17, the same Steps are denoted by the same reference numerals, and description thereof is omitted. In Step 228, an intake-pipe pressure $PM_0$ (the output of the filter 7 having a time constant 3 to 6 msec) which has been A/D converted and stored in the RAM 64 is fetched, and a weighted mean value $PM(a)_i$ is calculated in Step 230 according to the above-described equation (2). The intake-pipe pressure $PM_0$ corresponds to the first weighted mean value according to the third aspect of the present invention, and the weighted mean value $PM(a)_i$ corresponds to the second weighted mean value according to the third aspect of the present invention. In Step 232, the weighted mean value $PM(a)_i$ is subtracted from the intake-pipe pressure $PM_0$ to calculate a deviation ΔPM, and asynchronous fuel injection is then executed in Steps 222 to 226 in a manner similar to the above.

Thus, in this embodiment, the timing at which asynchronous fuel injection is executed is determined on the basis of the deviation of the weighted mean value $PM(a)_i$ from the intake-pipe pressure $PM_0$ obtained from the output of the filter 7 which has relatively good response to changes in the intake-pipe pressure. Therefore, it is possible to execute asynchronous fuel injection at timing which is closer to the theoretically required timing than that in the above-described embodiment.

As described above, according to this embodiment, the effect of the pulsating component of the intake-pipe pressure can be removed by changing the coefficient K which corresponds to the weight which is given to a mean value and thereby changing the size of the weight. It is therefore possible to employ a filter having a relatively small time constant and consequently execute asynchronous fuel injection at timing which is closer to the theoretically required timing than that in the conventional fuel injection systems. In consequence, it is possible to improve the condition of exhaust emission and the engine performance during acceleration. In the case of asynchronous fuel injection which is triggered by the second-order differentiated value of the intake-pipe pressure, words for carrying out differentiation of second order are needed, and this increases the number of words required as a whole. However, since in this embodiment the difference between weighted mean values is calculated, it is possible to reduce the number of words required in terms of software. Further, the execution timing of asynchronous fuel injection can be advanced by means of a relatively simple logic. In addition, even a fuel injection apparatus in which synchronous incremental injection is carried out on the basis of a weighted mean value of intake-pipe pressure can incorporate a standardized software logic, which means that the logic can be simplified.

It should be noted that, although in this embodiment a weighted mean value is detected on the basis of a signal passed through the filter, a weighted mean value may be detected directly from the output of the pressure sensor. Further, all the required weighted mean values may be detected using filters.

An eighth embodiment of the present invention will be described below.

In this embodiment also, the present invention is applied to a system in which fuel is injected asynchronously with the crank angle.

Figure 20:
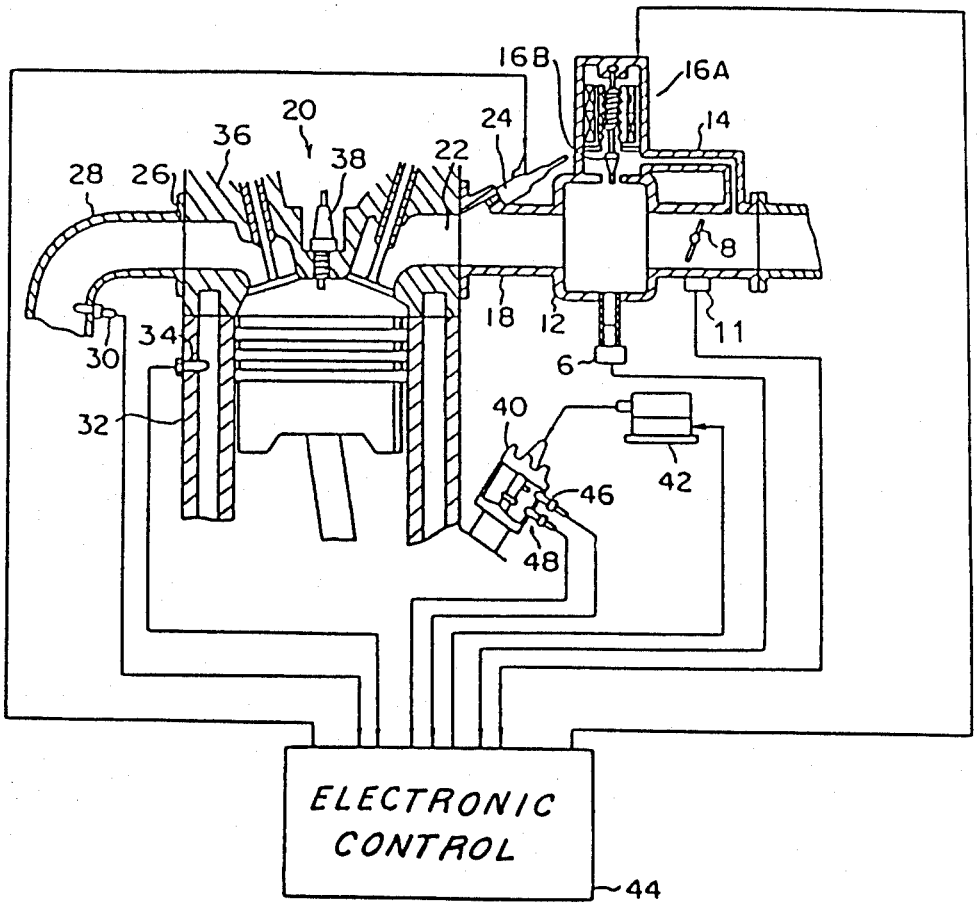
FIG. 20 schematically shows an engine to which an eighth embodiment of the present invention may be applied.
Figure 21:
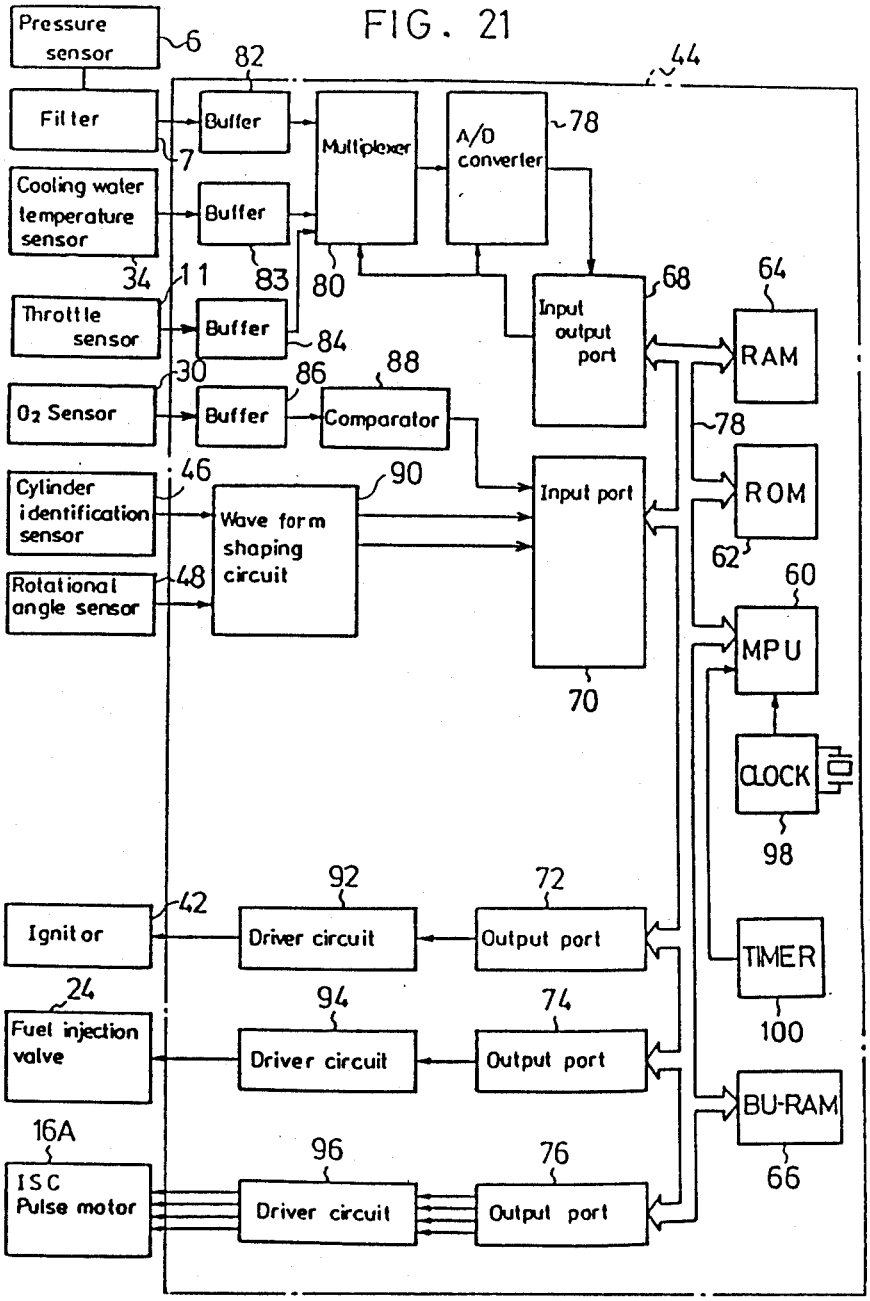
FIG. 21 is a block diagram showing in detail the control circuit shown in FIG. 20.

FIG. 20 schematically shows an engine to which this embodiment may be applied, and FIG. 21 is a block diagram of the control circuit shown in FIG. 20. In these figures, portions and elements which have the same arrangements as those shown in FIGS. 3 and 15 are denoted by the same reference numerals, and description thereof is omitted Description will be made below only about portions or members which are different from those described above Referring to FIG. 20, the throttle valve 8, which is disposed on the downstream side of the air clearner (not shown), is provided with a linear throttle sensor 11 in place of the idling switch 4 shown in FIG. 3. The throttle sensor 11 is constituted by a contactor rigidly secured to the shaft of the throttle valve 8 and a resistor which is in contact with the contactor, and adapted to output a voltage proportional to the degree of opening of the throttle valve 8. The arrangement of the other part of the engine is the same as that shown in FIG. 3. Referring to FIG. 21, the throttle sensor 11 is connected to the input/output port 68 in the control circuit 44 through the analog-to-digital (A/D) converter 78, the multiplexer 80 and the buffer 84. The arrangement of the other part of the control circuit 44 is the same as that shown in FIG. 15.

A control routine in accordance with this embodiment will be explained below.

Figure 22:
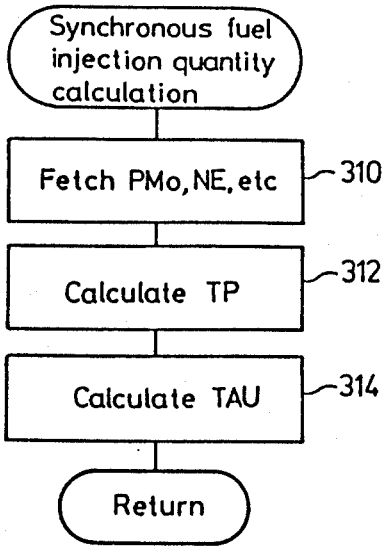
FIG. 22 is a flowchart showing a synchronous fuel injection quantity calculating routine in accordance with the eighth embodiment.

FIG. 22 shows an asynchronous fuel injection quantity calculating routine in accordance with the eighth embodiment which is executed every crank angle of 180° or 360°. In Step 310, various data items are fetched, such as an intake pipe pressure $PM_0(PM_{0i})$ corresponding to a first weighted mean value which has been input to the control circuit 44 from the pressure sensor 6 through the filter 7, A/D converted and stored in the RAM 64, an engine speed NE, etc. A basic fuel injection quantity TP is calculated in Step 312 on the basis both the intake-pipe pressure $PM_0$ and the engine speed NE. The calculated basic fuel injection quantity TP is corrected in Step 314 in accordance with an air-fuel ratio feedback correction coefficient obtained on the basis of the output of the $O_2$ sensor 30, an intake-air temperature and an engine cooling water temperature to obtain a target fuel injection quantity TAU. Then, the fuel injection valve 24 is opened to inject fuel for a period of time corresponding to the fuel injection quantity TAU in synchronism with the crank angle (e.g., the top dead center during intake stroke) in accordance with a fuel injection quantity control routine (not shown) It should be noted that the calculation of TAU may be carried out in a manner similar to that in the above-described first to fifth embodiments.

Figure 23:
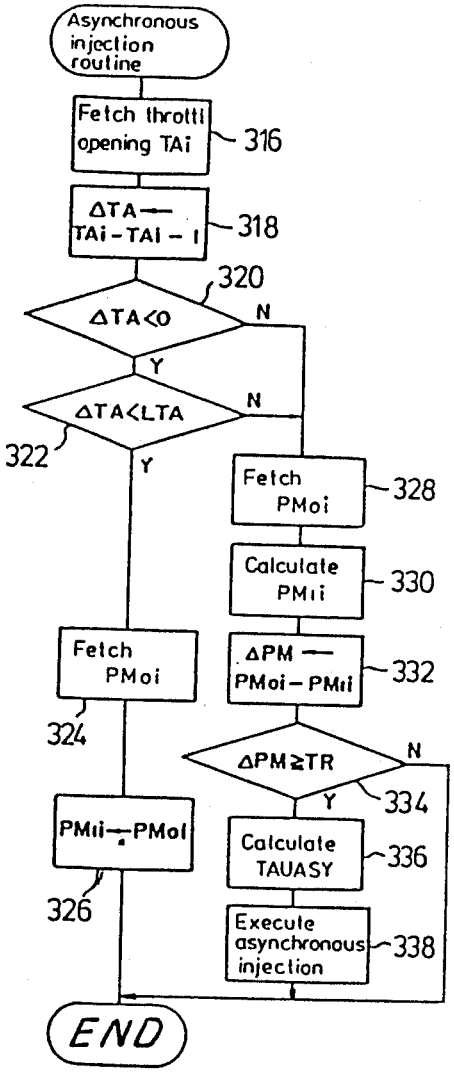
FIG. 23 is a flowchart showing an asynchronous fuel injection routine in accordance with the eighth embodiment.
Figure 2C:
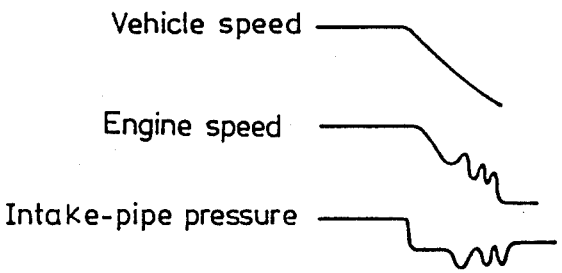
FIG. 2C is a chart showing changes in the rotational speed of the engine and changes in the intake-pipe pressure during deceleration.

Referring to FIG. 23, which shows a main routine in accordance with this embodiment which is executed every predetermined period of time (e.g., 12 msec) or every predetermined crank angle, a present throttle opening $TA_i$ and a previous throttle opening $TA_{i-1}$ are fetched in Step 316 from among those which are A/D converted every predetermined period of time and stored in the RAM 64. The previous throttle opening $TA_{i-1}$ is subtracted from the present throttle opening $TA_i$ to calculate a rate $\Delta TA$ of change of the throttle opening in Step 318. A judgement is made in Step 320 as to whether or not the change rate $\Delta TA$ is negative in order to make a judgement as to whether or not the engine is in a deceleration condition. If YES, a judgement is made in Step 322 as to whether or not the change rate $\Delta TA$ is less than a predetermined negative value LTA for the purpose of preventing occurrence of chattering. If YES is the answer in Step 322, a first weighted mean value $PM_{0i}$ (equal to the filter output) obtained by A/D converting the output of the filter 7 is fetched in Step 324, and the value of the present first weighted mean value $PM_{0i}$ is set so as to be a value for the present second weighted mean value $PM_{1i}$ in Step 326.

As a result, when it is judged in Step 320 that the present running condition is deceleration, the value of the present second mean value $PM_{1i}$ is set so as to be equal to the value of the present first weighted mean value $PM_{0i}$ which has relatively good response to changes in the present intake-pipe pressure.

When it is judged in Step 320 that the rate $\Delta TA$ of change of the throttle opening is 0 or greater, or when it is judged in Step 322 that the change rate $\Delta TA$ is equal to or greater than the value LTA, the present running condition is judged to be acceleration, and a present first weighted mean value $PM_{0i}$ is fetched in Step 328. Then, a second present weighted mean value $PM_{1i}$ is calculated in Step 330 according to the following equation.

$$PM_{1i} = \frac{PM_{0i} + (K_1 - 1)PM_{1i-1}}{K_1} \quad (8)$$

where $PM_{1i-1}$ a past weighted mean value, and $K_1$ is determined in conformity with each type of engine although it is easy to carry out digital calculation if $K_1$ is any number selected from among 4, 16 and 32.

In Step 332, the present second weighted mean value $PM_{1i}$ is subtracted from the present first weighted mean value $PM_{0i}$ to obtain a deviation $\Delta PM$, and the deviation $\Delta PM$ and a predetermined positive value TR are compared with each other in Step 334. If the deviation $\Delta PM$ is judged to be not smaller than the value TR in Step 334, it is judged that there is a demand for asynchronous fuel injection, and a target asynchronous fuel injection quantity TAUASY is calculated in Step 336 according to the following equation:

$$TAUASY = k_2 \cdot \Delta PM \quad (9)$$

where $k_2$ is a constant.

Then, the fuel injection valve 24 is opened for a period of time corresponding to the asynchronous fuel injection quantity TAUASY to execute asynchronous fuel injection in Step 338. It it is judged in Step 334 that the deviation $\Delta PM$ is less than the value TR, the process returns to the main routine.

It should be noted that Step 322 may be omitted, and the asynchronous fuel injection quantity TAUASY in Step 336 may be a predetermined value.

Figure 24:
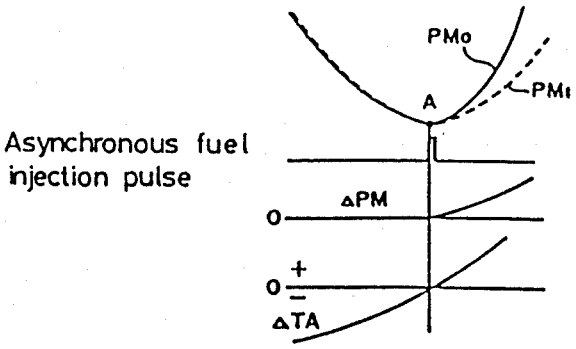
FIG. 24 is a chart showing the timing of asynchronous fuel injection in accordance with the eighth embodiment.

Thus, when the engine running condition shifts from deceleration to acceleration, the rate $\Delta TA$ of change of the throttle opening change from negative to positive, and therefore it is possible to detect a point of change from deceleration to acceleration. On the other hand, when the engine running condition has shifted from deceleration to acceleration, the first weighted mean value $PM_0$ changes substantially proportional to the actual change of the intake-pipe pressure, while the second weighted mean value $PM_1$ changes gently in response to actual changes in the intake-pipe pressure, as shown in FIG. 24. Accordingly, the weighted mean value devitation $\Delta PM$ takes a value which increases from 0 from a point (A) of change from deceleration to acceleration, and when the deviation $\Delta PM$ exceeds the predetermined value TR, asynchronous fuel injection is executed. The pulsating component of the intake-pipe pressure cannot completely be removed from the mean value $PM_0$ since it is substantially proportional to the output of the pressure sensor 6. However, in this embodiment the first weighted mean value $PM_0$ is compared with the second weighted mean value $PM_1$ which varies gently in response to changes in the intake-pipe pressure, whereby a change in intake-pipe pressure caused by the pulsating component and acceleration appears as a deviation $\Delta PM$. Therefore, it is possible to make a judgement as to whether or not acceleration has been started by setting the value TR at a value which is greater than the maximum value of the pulsating component. Thus, asynchronous fuel injection can be executed at the same time as the start of accelertion.

Figure 25:
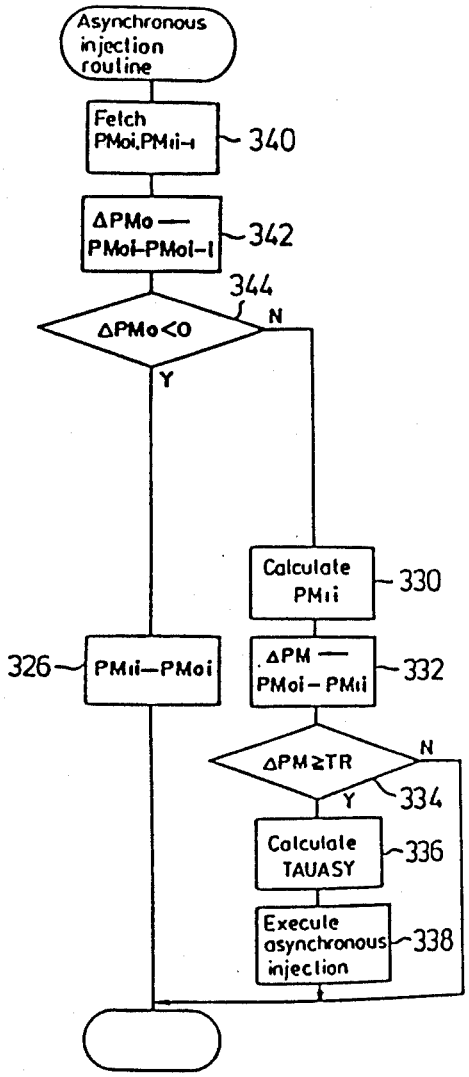
FIG. 25 is a flowchart showing an asynchronous fuel injection routine in accordance with a ninth embodiment of the present invention.

A ninth embodiment of the present invention will be explained below with reference to FIGS. 25 and 26. In this embodiment, deceleration or acceleration is detected from the rate of change of a first weighted mean value, and asynchronous fuel injection is executed in a manner similar to that in the eighth embodiment. Accordingly, Steps in the routine shown in FIG. 25 which correspond to those shown in FIG. 23 are denoted by the same reference numerals, and description thereof is omitted. In Step 340, a presently detected first weighted mean value $PM_{0i}$ and a previously detected first weighted mean value $PM_{0i-1}$ are fetched, and the previous first weighted mean value $PM_{0i-1}$ is subtracted from the present first mean value $PM_{0i}$ to calculate a rate $\Delta PM_0$ of change of first weighted mean value in Step 342. Then, a judgement is made in Step 344 as to whether or not the change rate $\Delta PM_0$ is negative in order to make a judgement as to whether or not the running condition has shifted from deceleration to acceleration.

Figure 26:
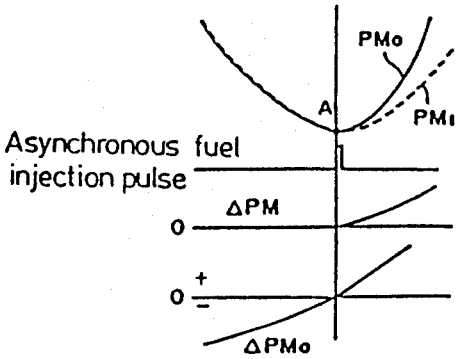
FIG. 26 is a chart showing the timing of asynchronous fuel injection in accordance with the ninth embodiment.

The curve representing the first weighted mean value $PM_0$ changes from descent to ascent at a point (A) of change from deceleration to acceleration as shown in FIG. 26. Therefore, it is possible to judge the running condition to be deceleration or acceleration by making a judgement as to whether or not the rate $\Delta PM_0$ of change of the first weighted mean value is negative When the running condition is judged to be deceleration, the value of the first weighted mean value $PM_{0i}$ is set so as to be a value for the second weighted mean value $PM_{1i}$ in Step 326 in a manner similar to that in the eighth embodiment, whereas, when the running condition is judged to be acceleration, a judgement is made as to whether or not the deviation $\Delta PM$ is equal to or greater than the predetermined value TR, and asynchronous fuel injection quantity is calculated to execute asynchronous fuel injection in a manner similar to that in the eighth embodiment.

As a result, asynchronous fuel injection is executed at a point of shift from deceleration to acceleration. It should be noted that the value of $PM_{0i}$ may be set so as to be a value for $PM_{1i}$ when $\Delta PM_0$ is less than a predetermined negative value as in the case of the eighth embodiment.

Figure 27:
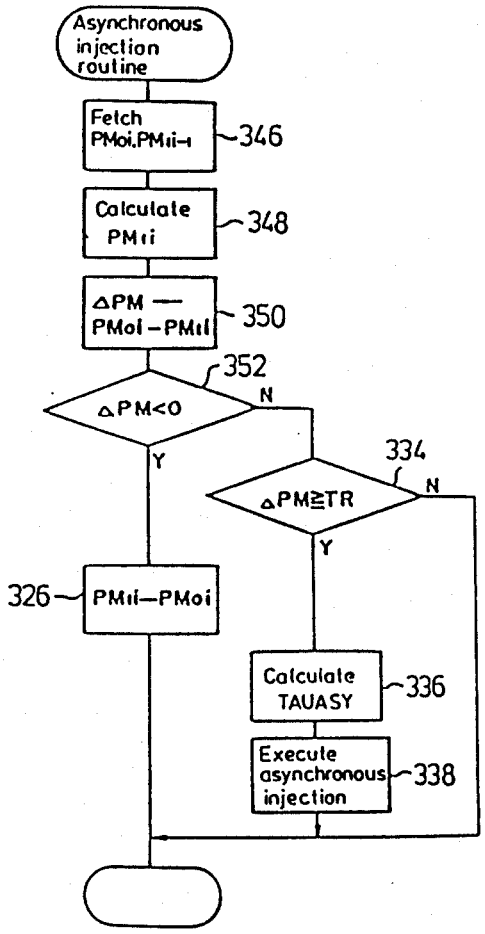
FIG. 27 is a flowchart showing an asynchronous fuel injection routine in accordance with a tenth embodiment of the present ivnention.

A tenth embodiment of the present invention will be explained below with reference to FIGS. 27 and 28. In this embodiment, the running condition is judged to be deceleration or acceleration by making a judgement as to whether or not a deviation $\Delta PM$ of a present second weighted mean value $PM_{1i}$ from a present first weighted mean value $PM_{0i}$ is negative, and asynchronous fuel injection is thereby executed in a manner similar to that in the eighth embodiment. Accordingly, Steps shown in FIG. 27 which correspond to those shown in FIG. 23 are denoted by the same reference numerals, and description thereof is omitted.

A present first weighted mean value $PM_{0i}$ which has been A/D converted and stored in the RAM 64 and a previous second weighted mean value $PM_{1i-1}$ which has been calculated and stored in the RAM 64 are fetched in Step 346, and a present second weighted mean value $PM_{1i}$ is calculated according to the above-described equation (8) in Step 348. The present second weighted mean value $PM_{1i}$ is subtracted from the present first weighted mean value $PM_{0i}$ to calculate a deviation $\Delta PM$ in Step 350. A judgement is made in Step 352 as to whether or not the deviation $\Delta PM$ is negative in order to judge the present running condition to be deceleration or acceleration. When the running condition is judged to be deceleration, the value of the present first weighted mean value $PM_{0i}$ is set so as to be a value for the present second weighted mean value $PM_{1i}$. On the other hand, when the deviation $\Delta PM$ is judged to be 0 or greater, it is judged that the engine is in an acceleration state, and a judgement is made as to whether or not the deviation $\Delta PM$ is equal to or greater than a predetermined positive value TR. If YES, a target asynchronous fuel injection quantity TAUASY is calculated, and asynchronous fuel injection is then executed.

The present second weighted mean value $PM_{1i}$ is calculated according to the equation (8) in Step 348, and the value of the present first weighted mean value $PM_{0i}$ is set so as to be a value for the present second weighted mean value $PM_{1i}$ in Step 326. In this case, if the present first weighted mean value $PM_{0i}$ changes by $dPM_0$ within the calculation time (the above-described predetermined period of time), the present second weighted mean value $PM_{1i}$ changes by $dPM_0/K_1$. This change amount $dPM_0/K_1$ is calculated and set as a value for the deviation $\Delta PM$. On the other hand, as will be understood from FIG. 28, the change amount $dPM_0/K_1$ takes a negative value during deceleration and takes a positive value dueing acceleration. Accordingly, it is possible to judge the running condition to be deceleration or acceleration by making a judgement as to whether the deviation $\Delta PM$ is positive or negative.

Figure 28:
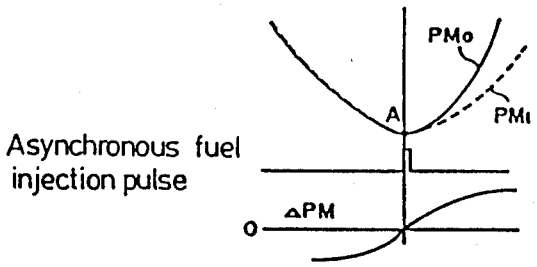
FIG. 28 is a chart showing the timing of asynchronous fuel injection in accordance with the tenth embodiment.

FIG. 28 shows the timing at which asynchronous fuel injection is executed by the control effected as described above.

Figure 29:
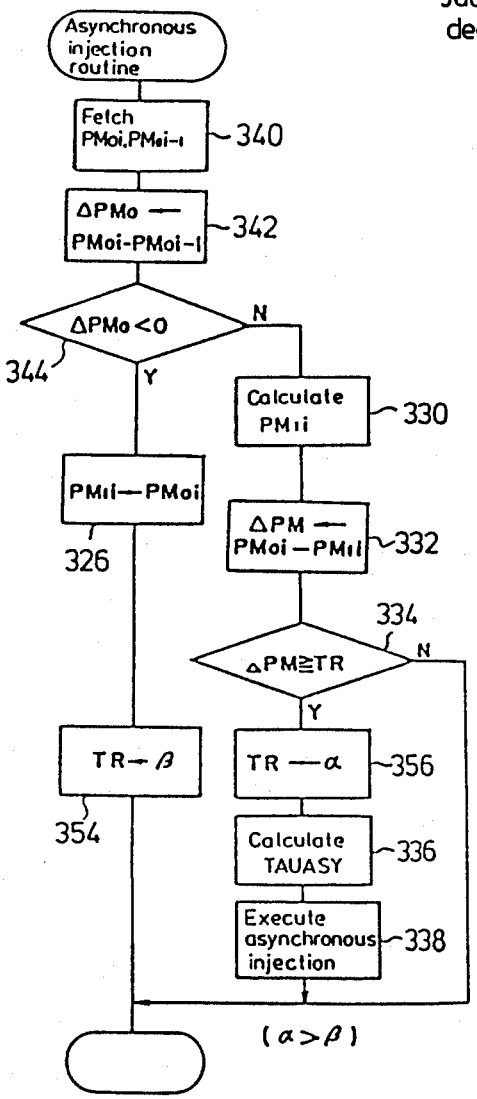
FIG. 29 is a flowchart showing an asynchronous fuel injection routine in accordance with an eleventh embodiment of the present invention.

An eleventh embodiment of the present invention will be explained below with reference to FIGS. 29 and 30. In this embodiment, the present running condition is judged to be deceleration or acceleration in accordance with the rate $\Delta PM_0$ of change of the first weighted means value in a manner similar to that in the ninth embodiment, and the size of the value TR employed to trigger asynchronous fuel injection is varied in accordance with deceleration and acceleration. Accordingly, Steps in the routine shown in FIG. 29 which correspond to those shown in FIG. 25 are denoted by the same reference numerals, and description thereof is omitted.

When the present running condition is judged to be deceleration in Step 344, the value of the present first weighted mean value $PM_{0i}$ is set so as to be a value for the present second weighted mean value $PM_{1i}$ in Step 326 in a manner similar to that described above, and a constant $\beta$ is set as a value for TR. On the other hand, when the present running condition is judged to be acceleration in Step 344 and it is judged in Step 334 that there is a demand for asynchronous fuel injection, a constant $\alpha$ is set as a value for TR in Step 356, and asynchronous fuel injection is executed in a manner similar to that described above. The constant $\beta$ is set so as to be smaller than the constant $\alpha$ as shown in FIG. 30.

Figure 30:
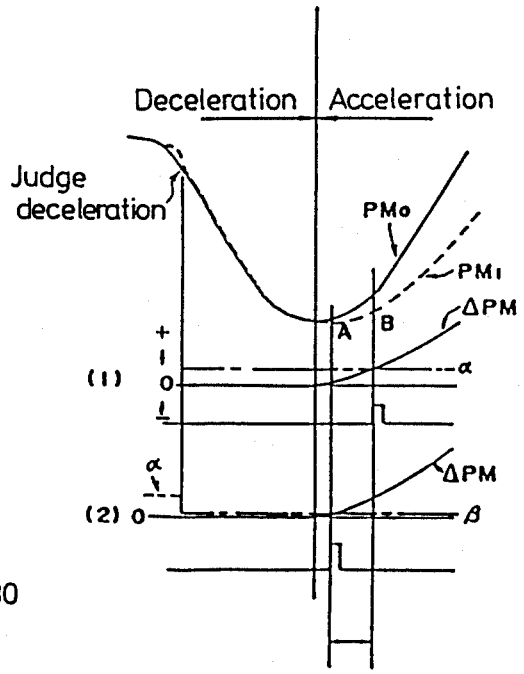
FIG. 30 is a chart showing the timing of asynchronous fuel injection in accordance with the eleventh embodiment.

Accordingly, the value TR employed to decide execution of asynchronous fuel injection during deceleration is made smaller than that during acceleration [see FIG. 30(2)]. Therefore, an asynchronous fuel injection operation which is first executed after the running condition has shifted from deceleration to acceleration is carried out in accordance with the result of comparison between the deviation $\Delta PM$ and the constant $\beta$, and asynchronous fuel injection operations which follow the first injection operation are executed in accordance with the result of comparison between the deviation $\Delta PM$ and the constant $\alpha$.

Figure 31:
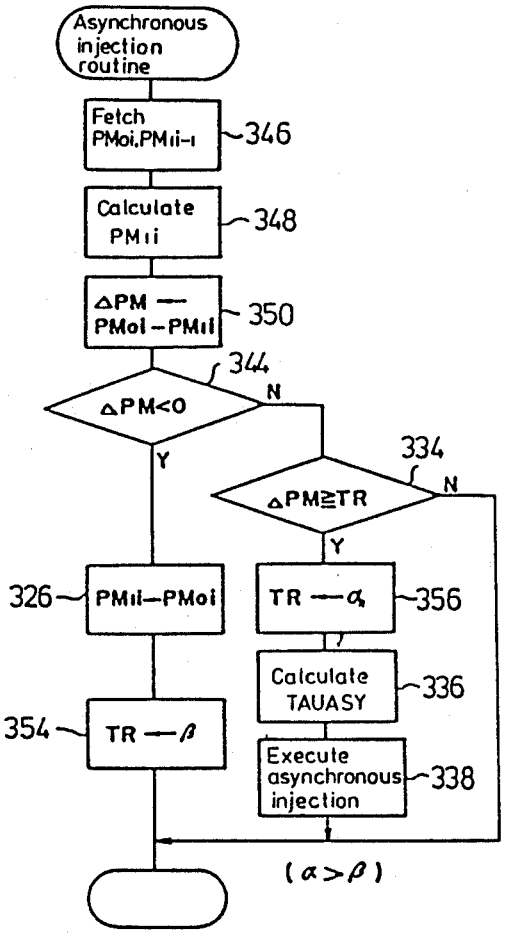
FIG. 31 is a flowchart showing an asynchronous fuel injection routine in accordance with a twelfth embodiment of the present invention.

Thus, in this embodiment, asynchronous fuel injection is executed when the size of the deviation $\Delta PM$ is relatively small, and it is therefore possible to execute asynchronous fuel injection at timing which is closer to the theoretically required timing than that in the eighth to tenth embodiments. FIG. 30(1) shows the timing at which asynchronous fuel injection is executed in the conventional asynchronous fuel injection systems A twelfth embodiment of the present invention will be explained below with reference to FIG. 31. In this embodiment, the present running condition is judged to be deceleration or acceleration by making a judgement as to whether the rate $\Delta PM_0$ of change of the first weighted mean value is positive or negative, and the value TR employed to decide that asynchronous fuel injection be needed is varied in size depending upon whether the present running condition is deceleration or acceleration. Accordingly, Steps in the routine shown in FIG. 31 which correspond to those shown in FIGS. 27 and 29 are denoted by the same reference numerals, and description thereof is omitted. It should be noted that, in this embodiment, the present running condition may be judged to be deceleration or acceleration by making a judgement as to whether the rate $\Delta PM$ of change of the throttle opening is positive or negative as in a manner similar to that in the eighth embodiment, or by making a judgement as to whether the rate $\Delta PM_0$ of change of the first weighted mean value is positive or negative as described in the ninth embodiment.

As described above, it is possible, according to this embodiment, to remove the effect of the pulsating component of the intake-pipe pressure by changing the coefficient K which corresponds to the weight which is given to mean values and thereby changing the size of the weight. It is therefore possible to employ a filter having a relatively small time constant and consequently execute asynchronous fuel injection at timing which is closer to the theoretically required timing than that in the conventional fuel injection systems. In consequence, it is possible to improve the condition of exhaust emission and the engine performance during acceleration. In the case of asynchronous fuel injection which is triggered by the second-order differentiated value of the intake-pipe pressure, words for carrying out differentiation of second order are needed, and this increases the number of words required as a whole. However, since in this embodiment the difference between weighted mean values is calculated, it is possible to reduce the number of words required in terms of software. Further, the execution timing of asynchronous fuel injection can be advanced by means of a relatively simple logic. In addition, even a fuel injection apparatus in which synchronous incremental injection is carried out on the basis of a weighted mean value of intake-pipe pressure can incorporate a standardized software logic, which means that the logic can be simplified.

It should be noted that, although in this embodiment the first weighted mean value is detected on the basis of a signal passed through the filter, the signal passed through the filter may be subjected to arithmetic processing to detect the first weighted mean value, or the first weighted mean value may be detected directly from the output of the pressure sensor by calculation. Further, the second weighted mean value may be detected directly from the output of the pressure sensor by calculation, and all the required weighted mean values may be detected using filters.

A thirteenth embodiment of the present invention will be explained below.

In this embodiment, the present invention is applied to an arrangement for controlling a fuel injection quantity for an internal combustion engine equipped with an automatic transmission which enables fuel injection quantity to be increased when the automatic transmission is shifted during idling and which prevents fuel injection quantity from being increased during deceleration.

Figure 32:
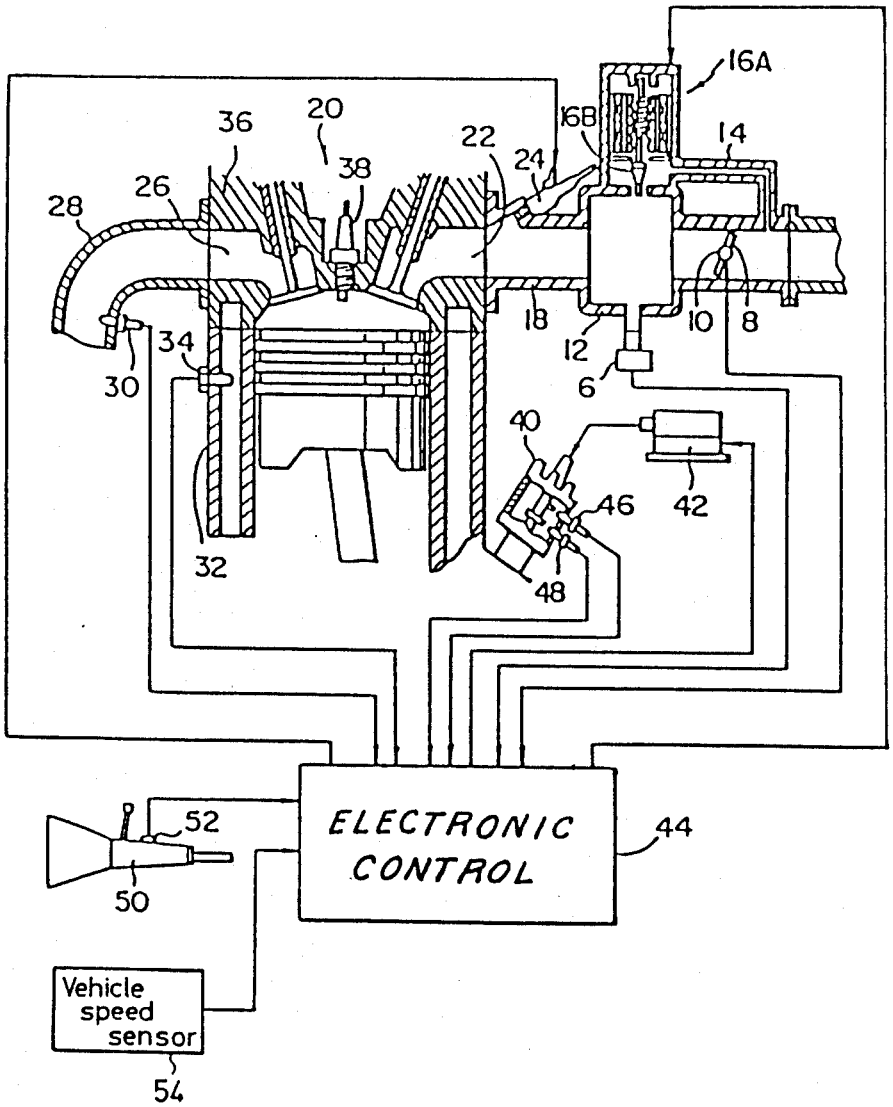
FIG. 32 schematically shows an engine to which a thirteenth embodiment of the present invention may be applied.

FIG. 32 schematically shows an engine to which this embodiment may be applied. In the arrangement shown in FIG. 32, the same portions and elements as those shown in FIG. 3 are denoted by the same reference numerals, and description thereof is omitted.

In this embodiment, a neutral switch 52 and a vehicle speed sensor 54 are connected to the electronic control circuit 44. The neutral switch 52 is provided on an automatic transmission 50 and adapted to turn ON when the shift lever is positioned in a non-drive range such as N range and P range and turn OFF when the shift lever is positioned in a drive range such as D range and R range. The vehicle speed sensor 54 is constituted by a magnet rigidly secured to a speed meter cable and a magnetic sensitive element The arrangement of the other part of the engine is the same as that shown in FIG. 3.

Figure 33:
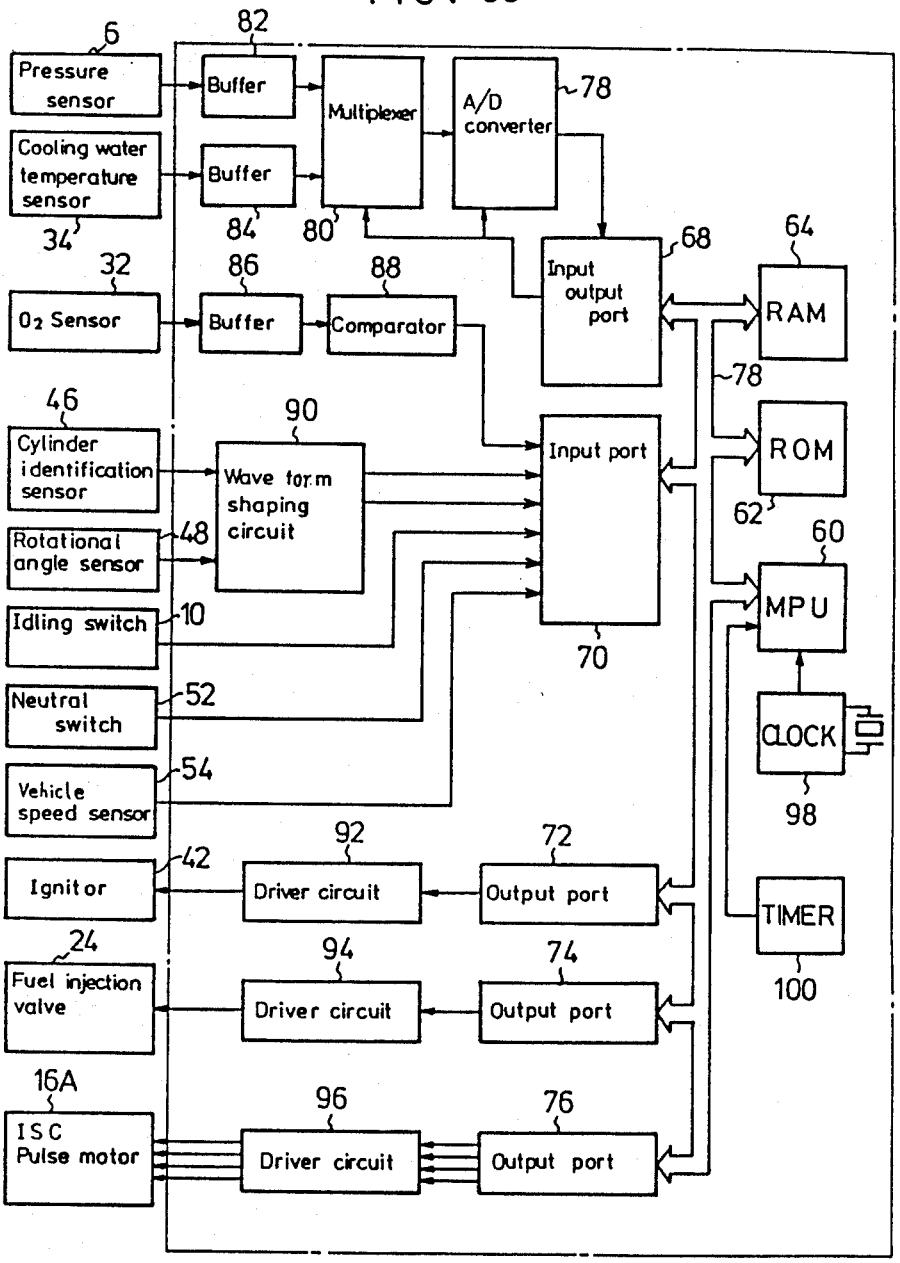
FIG. 33 is a block diagram showing in detail the control circuit shown in FIG. 32.

FIG. 33 is a block diagram of the electronic control circuit 44 in accordance with this embodiment. Since the arrangement of the control circuit 44 is similar to that shown in FIG. 4, the portions and elements as those shown in FIG. 4 are denoted by the same reference numerals, and portions which are different from those shown in FIG. 4 alone will be described below.

The $O_2$ sensor 32 is connected to the input port 70 in the control circuit 44 through the comparator 88 and the buffer 86, and the cylinder identification sensor 46 and the rotational angle sensor 48 are also connected to the input port 70 through the waveform shaping circuit 90. Further, the idling switch 10, the neutral switch 52 and the vehicle speed sensor 54 are connected directly to the input port 70. The arrangement of the other part of the control circuit 44 is the same as that shown in FIG. 4.

A control routine in accordance with the thirteenth embodiment will be explained below with reference to FIG. 34. In the following, an example wherein weighted mean values are obtained by calculation will be described.

Figure 34:
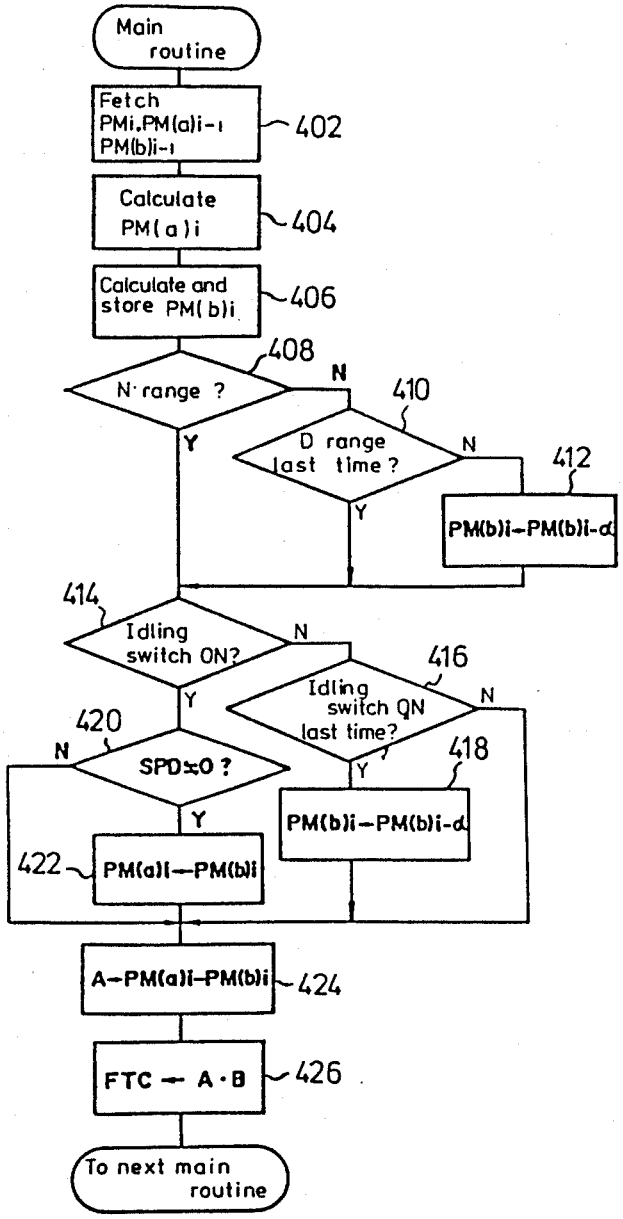
FIG. 34 is a flowchart showing a main routine in accordance with the thirteenth embodiment.

Referring to FIG. 34, which shows a part of the main routine in accordance with this embodiment, a present intake-pipe pressure $PM_i$ which has been A/D converted and stored in the RAM 64 and first and second weighted mean values $PM(a)_{i-1}$ and $PM(b)_{i-1}$ which have previously been calculated and stored in the RAM 64 are fetched in Step 402. Present first and second weighted mean values $PM(a)_i$ and $PM(b)_i$ are respectively calculated in Steps 404 and 406 according to the following equations:

$$PM(a)_i = \frac{PM_i + 3PM(a)_{i-1}}{4} \quad (10)$$

$$PM(b)_i = \frac{PM_i + 63PM(a)_{i-1}}{64} \quad (11)$$

The equations (10) and (11) are the same as the equations (2) and (3), respectively.

The calculated $PM(a)_i$ and $PM(b)_i$ are stored in the RAM 64 in place of the previous first and second weighted mean values $PM(a)_{i-1}$ and $PM(b)_{i-1}$, respectively.

Then, a judgement is made in Step 408 as to whether or not the shift lever of the automatic transmission 50 is set in N range on the basis of the output of the neutral switch 52. If YES, the process proceeds to Step 414, whereas, if NO is the answer, the process proceeds to Step 410, in which a judgement is made as to whether or not the shift lever was judged to be set in D range in the last processing of Step 408. If YES, the process proceeds to Step 414, whereas, if NO is the answer, that is, if the shift lever has been shifted from N range, which is a non-drive range, to D range, which is a drive range, the process proceeds to Step 412, in which the value of the second weighted mean value $PM(b)_i$ is decreased by a predetermined value $\alpha$, and the process then proceeds to Step 414.

A judgement is made in Step 414 as to whether or not the idling switch 10 is ON. If NO, that is, if the throttle valve 8 is in an open position, a judgement is made in Step 416 as to whether or not the idling switch 10 was judged to be ON in the last execution of Step 414. If NO is the answer in Step 416, the process proceeds to Step 424, whereas, if YES is the answer in Step 416, that is, if the throttle valve 8 has been shifted from a closing position to an open position, the process proceeds to Step 418, in which the value of the second weighted mean value $PM(b)_i$ is decreased by a predetermined value $\alpha$, and the process then proceeds to Step 424.

On the other hand, if it is judged in Step 414 that the idling switch 10 is ON, a judgement is made in Step 420 as to whether or not the vehicle speed SPD obtained on the basis of the output of the vehicle speed sensor 54 is 0. If the vehicle speed SPD is not 0, the value of the second weighted mean value $PM(b)_i$ is set so as to be a value for the first weighted mean value $PM(a)_i$, thereby making the first and second weighted mean values equal to each other.

In Step 424, the second weighted mean value $PM(b)_i$ is subtracted from the first weighted mean value $PM(a)_i$, and the result A of the subtraction is then multiplied by a constant B in Step 426, thereby calculating an incremental/decremental coefficient FTC.

As a result, when the shift lever of the automatic transmission 50 is shifted from a non-drive range to a drive range, or when the throttle valve 8 is shifted from a closing position to an open position, the value A is increased by a predetermined value $\alpha$, whereas, when the vehicle is running with the throttle valve 8 set in a closing position, the value A is made 0.

Figure 35:
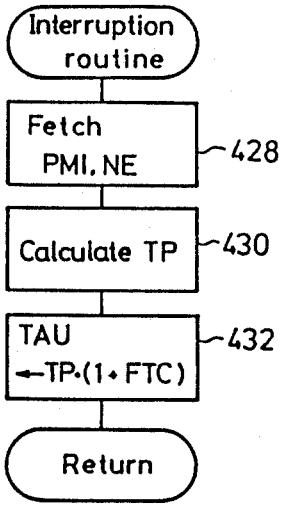
FIG. 35 is a flowchart showing an interruption routine in accordance with the thirteenth embodiment.

Referring to FIG. 35, which shows an interruption routine which is executed every predetermined crank angle (e.g., 30°), the present intake-pipe pressure $PM_i$ and the engine speed NE are fetched in Step 428, and a basic fuel injection quantity TP is calculated in Step 430 in a manner similar to that in the conventional method. In Step 432, a target fuel injection quantity TAU is calculated according to the following equation, and fuel injection is executed every predetermined crank angle in accordance with a fuel injection routine (not shown):

$$TAU = TP \cdot (1 + FTC) \cdot FAF \quad (12)$$

The reference symbol FAF in the equation (12) denotes an air-fuel ratio feedback correction coefficient employed for controlling the air-fuel ratio to a stoichiometric level on the basis of the output of the $O_2$ sensor 32.

When the incremental/decremental coefficient FTC in the equation (12) is made zero by making the value A zero, the increment or decrement of the fuel injection quantity is suspended, whereas, when FTA is increased by increasing the value A by a predetermined value $\alpha$, the increment of the fuel injection is effected.

It should be noted that the main routines shown in FIGS. 5,7,9,11,17 and 19 can be conducted immediately after the PM is A/D converted every predetermined period of time, for example, every 4 msec or 2 msec.

It should be noted that, although in this embodiment the increment or decrement of the fuel injection quantity is suspended by making the first and second weighted mean value equal to each other, the correction of the fuel injection quantity may be suspended by making the incremental/decremental coefficient zero after calculating this coefficient. Further, the constant K corresponding to the weight which is given to mean values is selected so as to be optimal for each type of engine. In addition, although in this embodiment the first and second weighted mean values are obtained by calculation, they may be obtained using two filters such as CR filters which have different time constants.

Although the present invention has been described through specific terms, it should be noted here that the described embodiments are not necessarily exclusive and various changes and modifications may be imparted thereto without departing from the scope of the invention which is limited solely by the appended claims.

What is claimed is:

1. A fuel injection method for an internal combustion engine, comprising the steps of:

(a) determining a present first weighted mean value of intake-pipe pressure by using a first weighted means weight given to said first weighted means value determined in the past;

(b) determining a present second weighted means value of intake-pipe pressure and making a weight given to said second weighted means value determined in the past heavier than the weight given to said first weighted means value determined in the past in said step (a);

(c) subtracting said present second weighted mean value from said present first weighted mean value; and (d) injecting fuel asynchronously with the crank angle when a result of said subtraction exceeds a predetermined value.

2. A fuel injection method according to claim 1, wherein in said step (c) said present first weighted mean value is set so as to be said present second weighted mean value during deceleration.

3. A fuel injection method according to claim 1, wherein said present first weighted mean value is determined by passing the output of a pressure sensor for detecting an intake-pipe pressure through a filter having a time constant which enables removal of a pulsating component of the intake-pipe pressure.

4. A fuel injection method according to claim 1, wherein said present first weighted mean value is as determined using as said present intake-pipe pressure a signal obtained by passing the output of a pressure sensor for detecting an intake-pipe pressure through a filter having a time constant which enables removal of a pulsating component of the intake-pipe pressure.

5. A fuel injection method according to claim 1, wherein in said step (d), when the result of said subtraction exceeds a predetermined value, an amount of fuel which is proportional to the result of said subtraction is injected asynchronously with the crank angle.

6. A fuel injection method according to claim 1, wherein in said step (c) a judgement is made as to whether or not the present running condition is deceleration on the basis of any one of the following three factors, that is, the rate of change in the degree of opening of a throttle valve, said present first weighted mean value, and the result of subtraction of said present second weighted mean value from said present first weighted mean value, and when the present running condition is judged to be deceleration, the value of said present first weighted mean value is set so as to be a value for said present second weighted mean value, whereas, when the present running condition is judged to be acceleration, said present second weighted mean value is subtracted from said present first weighted mean value, whereby the result of said subtraction is made to take a positive value from a point of change from deceleration to acceleration.

7. A fuel injection method according to claim 1, wherein in said step (d), immediately after the running condition has shifted from deceleration to acceleration, fuel is injected asynchronously with the crank angle when the result of said subtraction exceeds a first predetermined value, and after this asynchronous fuel injection has been executed, fuel is injected asynchronously with the crank angle when the result of said subtraction exceeds a second predetermined value which is larger than said first predetermined value.

8. A fuel injection method for an internal combustion engine, comprising the steps of:

(a) determining a present first weighted mean value of intake-pipe pressure by using a first weighted mean value of an intake-pipe pressure determined in the past and a present intake-pipe pressure an making heavier a weight given to said first weighted mean value determined in the past;

(b) determining a present second weighted means value intake-pipe pressure by using a second weighted mean value of said intake-pipe pressure determined in the past and said present intake-pipe pressure and making a weight given to said second weighted mean value determined in the past heavier than the weight given to said first weighted mean value determined in the past in said step (a);

(c) subtracting said present second weighted mean value from said present first weighted mean value;

(d) increasing the fuel injection quantity, when an automatic transmission is shifted from a non-drive range to a drive range during idling, on the basis of a result of said subtraction in said step (c); and (e) suspending the increase of the fuel injection quantity on the basis of the result of said subtraction when the vehicle is running in a state wherein a throttle valve is in a closing position.

9. An apparatus for controlling a fuel injection quantity for an internal combustion engine, comprising:

pressure detecting means for detecting an intake pipe pressure;

first means for determining a present first weighted mean value of intake-pipe pressure by using a first weighted means value of an intake-pipe pressure determined in the past and a present intake-pipe pressure and making heavier the weight given to said first weighted means value determined in the past;

second means for determining a present second weighted mean value of intake-pipe pressure by using a second weighted means value of said intake-pipe pressure determined in the past and said present intake-pipe pressure and making the weight given to said second weighted mean value determined in the past heavier than the weight given to said first weighted mean value determined in the past by said first means;

calculating means for determining an incremental/decremental quantity for the fuel injection quantity on the basis of a value obtained by subtracting said present second weighted mean value from said present first weighted mean value; and fuel injection means for varying the fuel injection quantity on the basis of said incremental/decremental quantity.

10. An apparatus according to claim 9, wherein said first means determined said present weighted mean value by carrying out a calculation according to the following equation, the constant K in which is set at a predetermined value, and said second means detects said present second weighted mean value by carrying out said calculation according to the following equation, the constant K in which is made larger than that employed by said first means:

$$\overline{PM_i} = \frac{PM_i + (K-1)\,\overline{PM_{i-1}}}{K}$$

where $PM_i$ is a present intake-pipe pressure determined by said pressure detecting means, $\overline{PM_{i-1}}$ is a weighted means value of intake-pipe pressure determined in the past, $\overline{PM_i}$ is a weighted mean value of intake-pipe pressure detected at present, and K is a constant corresponding to the weight.

11. An apparatus according to claim 9, wherein said calculating means makes said inremental/decremental quantity for the fuel injection quantity smaller in the case of a relatively high engine temperature than in the case of a relatively low engine temperature.

12. An apparatus according to claim 9, wherein said first means determines said present first weighted means value by passing the output of said pressure detecting means through a filter having a time constant which enables removal of a pulsating component of the intake-pipe pressure.

13. An apparatus according to claim 9, wherein said first means determines said present first weighted mean value by using as said present intake-pipe pressure a signal obtained by passing the output of said pressure detecting means through a filter having a time constant which enables removal of a pulsating component of the intake-pipe pressure.

14. An apparatus according to claim 9, further comprising:

detecting means for detecting a point of change from deceleration to acceleration and vice versa, said calculating means being adapted to determine an incremental/decremental quantity for the fuel injection quantity on the basis of a value obtained by subtracting said present second weighted mean value from said present first weighted mean value, and set said incremental/decremental quantity at a predetermined positive value when a point of change from deceleration to acceleration is detected by said detecting means.

15. An apparatus according to claim 14, wherein said calculating means makes said incremental/decremental quantity zero when said point of change is detected.

16. An apparatus according to claim 14, wherein said change point detecting means detects said change point on the basis of both a third weighted mean value and a value which varies substantially proportional to the change of the intake-pipe pressure, said third weighted mean value being determined in accordance with a weight which is set so as to be intermediate between the weights for said first and second weighted mean values and in accordance with a present intake-pipe pressure.

17. An apparatus according to claim 16, wherein said change point detecting means detects as said change point a point of time at which said third weighted mean value and said value which varies substantially proportional to the change of said intake-pipe pressure become equal to each other.

18. An apparatus according to claim 14, wherein said change point detecting means detects said change point on the basis of both a past intake-pipe pressure and a present intake-pipe pressure.

19. An apparatus according to claim 18, wherein said change point detecting means detects as said change point a point of time at which said past intake-pipe pressure and said present intake-pipe pressure become equal to each other.

20. An apparatus for controlling a fuel injection quantity for an internal combustion engine, comprising:

a pressure sensor for detecting an intake-pipe pressure;

a filter connected to said pressure sensor and having a time constant which enables removal of a pulsating component of the intake-pipe pressure;

a rotational speed sensor for detecting a rotational speed of the engine;

first mean value calculating means for calculating a present first weighted mean value of the output of said filter by using a first weighted mean value of the filter output calculated in the past and a present filter output and making heavier the weight given to said first weighted means value calculated in the past;

second mean value calculating means for calculating a present second weighted means value of the output of said filter by using a second weighted means value of the filter output calculated in the past and the present filter output and making the weight given to said second weighted means value calculated in the past heavier than that given by said first means value calculating means;

first calculating means for calculating a basic fuel injection duration on the basis of both the output of said filter and the output of said rotational speed sensor;

second calculating means for calculating a deviation by subtracting said present second weighted mean value from said present first weighted means value;

third calculating means for calculating an incremental/decremental quantity coefficient for increasing or decreasing fuel injection quantity based on said deviation from said second calculating means, and for calculating a synchronous fuel injection duration for injecting fuel synchronously with the crank angle by correcting said basic fuel injection duration according to said incremental/decremental quantity coefficient;

fourth calculating means for calculating an asynchronous fuel injection duration for injecting fuel asynchronously with the crank angle on the basis of said deviation; and fuel injecting means for executing fuel injection by opening a fuel injection valve for a period of time corresponding to either said synchronous fuel injection duration or said asynchronous fuel injection duration.

* * * * *